US008684856B2

(12) United States Patent
Pyrce et al.

(10) Patent No.: US 8,684,856 B2
(45) Date of Patent: Apr. 1, 2014

(54) INFANT SWING AND GLIDER DEVICE

(75) Inventors: Philip Pyrce, Getzville, NY (US); Maarten Van Huystee, Lancaster, NY (US); Jeffrey W. Luchterhand, Clarence, NY (US)

(73) Assignee: Mattel, Inc., El Segundo, CA (US)

( * ) Notice: Subject to any disclaimer, the term of this patent is extended or adjusted under 35 U.S.C. 154(b) by 299 days.

(21) Appl. No.: 13/038,729

(22) Filed: Mar. 2, 2011

(65) Prior Publication Data

US 2011/0230272 A1 Sep. 22, 2011

Related U.S. Application Data

(60) Provisional application No. 61/314,771, filed on Mar. 17, 2010.

(51) Int. Cl.
*A63G 9/16* (2006.01)
*A63G 9/00* (2006.01)

(52) U.S. Cl.
USPC ..... 472/119

(58) Field of Classification Search
USPC ..... 472/119–125; 297/258.1, 260.1, 261.1; 5/105–109
See application file for complete search history.

(56) References Cited

U.S. PATENT DOCUMENTS 1,795,246 A 3/1931 Brown
1,874,345 A 8/1932 Parrott
1,906,768 A 5/1933 Romine
2,769,276 A 11/1956 Steiner
2,994,156 A 8/1961 Steiner et al.
3,290,817 A 12/1966 Kravath
3,758,149 A 9/1973 Emold
4,190,248 A 2/1980 Philippi
4,258,446 A 3/1981 McAllister et al.
4,333,637 A 6/1982 Shelton
4,656,680 A 4/1987 Wilson
4,752,980 A 6/1988 Nafte
4,805,902 A 2/1989 Casagrande
4,911,499 A 3/1990 Meeker
4,940,229 A 7/1990 Foster
5,183,457 A 2/1993 Gatts et al.
5,313,961 A 5/1994 McKee
5,326,327 A 7/1994 Stephens et al.
5,352,145 A 10/1994 Raiffe et al.
5,490,711 A 2/1996 Pollock
5,533,936 A 7/1996 Julien et al.
5,618,016 A 4/1997 Garland et al.
5,711,045 A 1/1998 Caster et al.
5,833,545 A 11/1998 Pinch et al.
5,863,097 A 1/1999 Harper et al.
5,890,762 A 4/1999 Yoshida
6,027,409 A 2/2000 Favorito et al.
6,059,667 A 5/2000 Pinch
6,163,326 A 12/2000 Klein et al.
6,343,994 B1 2/2002 Clarke
6,412,867 B2 7/2002 Robinson (Continued)

*Primary Examiner* — Kien Nguyen
(74) *Attorney, Agent, or Firm* — Edell, Shapiro & Finnan, LLC

(57) ABSTRACT

An infant swing includes a base, a support coupled to the base, an arm coupled to and movable relative to the support, and a seat portion coupled to the arm. A drive system is coupled to the arm and moves the arm relative to the base. An actuator is connected to the drive system, and is located so that a user can engage the actuator with the user's foot to control the drive system.

36 Claims, 26 Drawing Sheets

(56) References Cited

U.S. PATENT DOCUMENTS

| | | | | |
|---|---|---|---|---|
| 6,511,123 | B1 | 1/2003 | Sitarski et al. | |
| 6,702,685 | B2 | 3/2004 | Mahlstedt et al. | |
| 6,824,473 | B2 | 11/2004 | Wu | |
| 6,994,630 | B2 * | 2/2006 | Paesang | 472/118 |
| 6,997,815 | B2 | 2/2006 | Devine | |
| 7,032,966 | B2 | 4/2006 | Myers | |
| 7,255,393 | B2 | 8/2007 | Flanagan | |
| 7,264,534 | B2 | 9/2007 | Stubenfoll | |
| 7,475,942 | B2 | 1/2009 | Boyle et al. | |
| 7,717,800 | B2 * | 5/2010 | Pyrce | 472/119 |
| 8,070,617 | B2 * | 12/2011 | Barron et al. | 472/118 |
| 2002/0113469 | A1 | 8/2002 | Stern et al. | |
| 2004/0075028 | A1 | 4/2004 | Wang | |
| 2005/0099384 | A1 | 5/2005 | Wu et al. | |
| 2006/0012230 | A1 | 1/2006 | Kennedy et al. | |
| 2006/0270480 | A1 | 11/2006 | Chen | |
| 2007/0018490 | A1 | 1/2007 | Jones | |
| 2007/0120404 | A1 | 5/2007 | Bellows et al. | |
| 2007/0129156 | A1 | 6/2007 | Greger et al. | |
| 2007/0205646 | A1 | 9/2007 | Bapst et al. | |
| 2007/0267904 | A1 | 11/2007 | Clapper et al. | |
| 2007/0289178 | A1 | 12/2007 | Lee et al. | |
| 2008/0098521 | A1 | 5/2008 | Westerkamp et al. | |
| 2008/0111413 | A1 | 5/2008 | Boyle et al. | |
| 2008/0111414 | A1 | 5/2008 | Sulzer | |
| 2008/0179928 | A1 | 7/2008 | Chen et al. | |
| 2009/0111593 | A1 | 4/2009 | Guang et al. | |

* cited by examiner

INFANT SWING AND GLIDER DEVICE

CROSS-REFERENCE TO RELATED APPLICATIONS

This application claims the benefit of and priority under 35 U.S.C. 119(e) to U.S. Provisional Application No. 61/314,771, entitled "Infant Swing and Glider Device", filed Mar. 17, 2010, the disclosure of which is incorporated herein by reference in its entirety.

FIELD OF THE INVENTION

The present invention relates to an infant swing, and in particular, to an infant swing having a seat portion that is selectively movable in either a gliding motion or a swinging motion.

BACKGROUND OF THE INVENTION

Various infant support structures for supporting an infant are known in the art. Infant support structures such as gliders and swings generally include a seat for receiving an infant, suspension arms having lower ends attached to the seat for suspending the seat above a support surface, and a support frame for pivotally supporting the upper ends of the suspension arms and the seat above the supporting surface.

Some conventional swings generally provide a pivotal or arcuate movement to the seat. Some conventional gliders generally provide a translational or linear movement to the seat.

Conventional support structures fail to provide for multiple modes of movement, which would otherwise provide for a variety of movement of a seat with an infant therein. In addition, conventional support structures fail to provide a control system that is easy to operate, such as a "hands-free" control system.

Therefore, there is a need for an infant support structure that can be easily activated by a foot or toe of a user. There is also a need for an infant support structure that provides multiple modes of movement.

SUMMARY OF THE INVENTION

The present invention relates to an infant swing including a base configured to be supported by a support surface, a support coupled to the base, an arm coupled to and movable relative to the support, a seat portion coupled to the arm, and a drive system. The seat portion is configured to support an infant. The drive system is coupled to the arm and moves the arm relative to the base. An actuator is connected to the drive system, and is located so that a user can engage the actuator with the user's foot to control the drive system.

In one embodiment, the arm is movable by the drive system relative to the base in a first type of motion and in a second type of motion different than the first type of motion. In one implementation, the first type of motion is a gliding motion relative to the base, and the second type of motion is a swinging motion relative to the base. In one embodiment, the drive system includes a first drive mechanism that moves the arm in the first type of motion and a second drive mechanism that moves the arm in the second type of motion.

In one embodiment, the actuator is located proximate to the support surface, and includes a plurality of inputs that are located proximate to the support surface. In one implementation, the actuator is removably coupled to the base.

In one embodiment, the support extends upwardly from the base and is movably coupled to the base. In one implementation, the support moves in a substantially horizontal reciprocating motion relative to the base.

The present invention is also directed to an infant swing having a base portion, a support coupled to the base portion, a seat portion coupled to the support, and a drive assembly. The seat portion is movable relative to the base portion in a gliding motion and in a swinging motion. The drive assembly is configured to move the seat portion relative to the base portion. The drive assembly includes a first drive mechanism that moves the seat portion in the gliding motion and a second drive mechanism that moves the seat portion in the swinging motion.

In one embodiment, the first drive mechanism is coupled to the base portion and the second drive mechanism is coupled to the seat portion. In one embodiment, the first drive mechanism moves the seat portion in a substantially linear motion relative to the base portion.

In one implementation, an input portion is connected to the drive assembly. The input portion includes at least one input configured to control at least one of the first drive mechanism or the second drive mechanism. In one implementation, the input portion is removably coupled to the base portion, and proximate to the support surface when coupled thereto so that a user can select the at least one input with a foot of the user.

The present invention is also directed to an infant swing including a base, a support movably coupled to the base, a hanger arm movably coupled to the support, a seat coupled to the hanger arm, and a drive assembly. The drive assembly is configured to move the support and the hanger arm relative to the base in a first type of motion, and also to move the hanger arm relative to the support and the base in a second type of motion different than the first type of motion.

In one embodiment, the first drive mechanism is coupled to the support and the base, and the second drive mechanism is coupled to the hanger arm and the support. In one implementation, the first drive mechanism moves the seat, the hanger arm, and the support in the first type of motion. The second drive mechanism moves the seat and the hanger arm relative to the support in the second type of motion. In one implementation, the first type of motion is substantially linear and the second type of motion is substantially accurate. The support moves linearly relative to the base in the first type of motion, and the support is substantially fixed relative to the base in the second type of motion.

In one embodiment, the seat includes a first coupling mechanism and the base includes a second coupling mechanism. The first coupling mechanism is configured to engage the second coupling mechanism to couple the seat to the first drive mechanism. The second drive mechanism is inoperable when the first coupling mechanism is coupled to the second coupling mechanism. The seat, the hanger arm, and the support move together in the first type of motion when the first coupling mechanism and the second coupling mechanism are coupled together.

In one embodiment, the hanger arm is pivotally coupled to the support. The support has an upper portion and a lower portion. The lower portion of the support is coupled to the base, and the hanger arm is coupled to the upper portion of the support.

The present invention also relates to an infant swing including a base, a movement system coupled to the base, and a receiving member coupled to the movement system. The movement system includes a first drive and a second drive. The receiving member is coupled to the movement system, and is configured to receive an infant. The first drive moves the receiving member in a gliding motion relative to the base, and the second drive moves the receiving member in a swinging motion relative to the base.

In one embodiment, only one of the first drive or the second drive is operable at one time. In one implementation, the movement system has a lock-out mechanism. When deployed, the lock-out mechanism limits the movement of the receiving member to the gliding motion. The receiving member is movable in the swinging motion when the lock-out mechanism is released.

In one embodiment, the movement system includes a foot-actuatable input mechanism. The input mechanism is connected to at least one of the first drive or the second drive. In one implementation, the input mechanism is removably coupled to the base.

In one embodiment, the base includes a slot, and the movement system includes a support arm extending upwardly from the base. The support arm is movable in the slot. In one implementation, the support arm includes an upper portion, and the receiving member is supported by the upper portion of the support arm.

BRIEF DESCRIPTION OF THE DRAWINGS

Like reference numerals have been used to identify like elements throughout this disclosure.

DETAILED DESCRIPTION OF THE INVENTION

It is to be understood that terms such as "left," "right," "top," "bottom," "front," "rear," "side," "height," "length," "width," "upper," "lower," "interior," "exterior," "inner," "outer" and the like as may be used herein, merely describe points or portions of reference and do not limit the present invention to any particular orientation or configuration. Further, terms such as "first," "second," "third," etc., merely identify one of a number of portions, components and/or points of reference as disclosed herein, and do not limit the present invention to any particular configuration or orientation.

Figure 1:
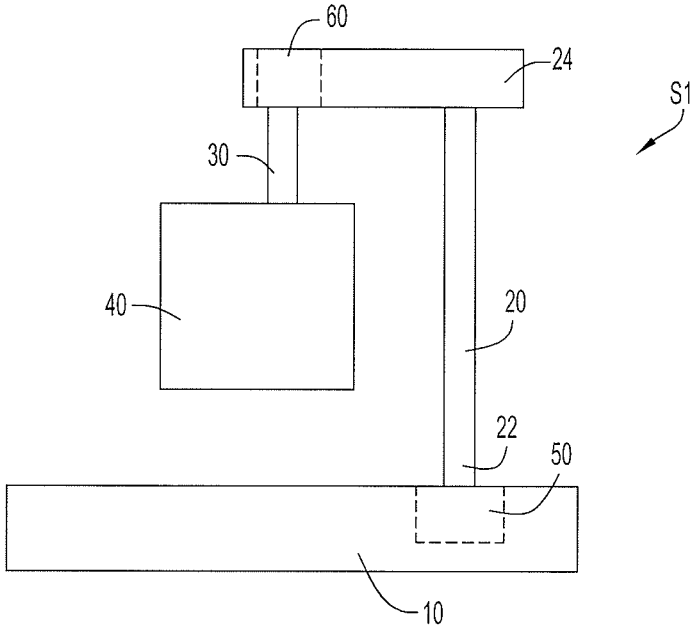
FIG. 1 illustrates a side view schematic diagram of an embodiment of an infant swing according to an embodiment of the present invention.
Figure 2:
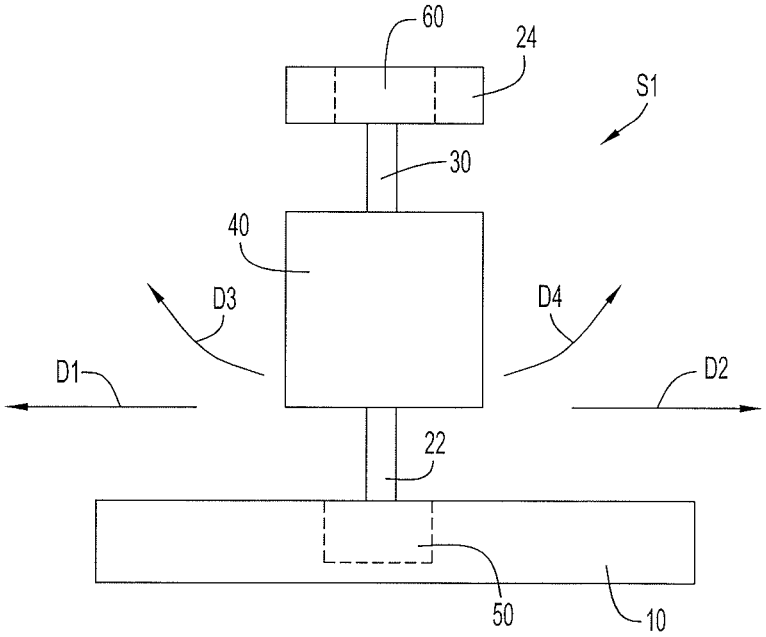
FIG. 2 illustrates a front view schematic diagram of the infant swing of FIG. 1.

FIGS. 1 and 2 illustrate schematic diagrams of an infant swing S1 according to an embodiment of the present invention. Swing S1 includes a base 10, a support 20 movably coupled to the base 10, an arm or hanger arm 30 movably coupled to the support 20, and a seat or seat portion 40 coupled to the hanger arm 30. The support 20 includes a lower portion 22 coupled to the base 10, and an upper portion 24 coupled to the hanger arm 30. Swing S1 further includes a drive assembly configured to move the support 20 and the hanger arm 30 relative to the base 10 in a first type of motion, and configured to move the hanger arm 30 relative to the support 20 and the base 10 in a second type of motion, the second type of motion being different than the first type of motion.

The drive assembly includes a first drive mechanism 50 and a second drive mechanism 60. The first drive mechanism 50 is coupled to the lower portion 22 of the support 20 and the base 10. The first drive mechanism 50 moves the seat 40, the hanger arm 30, and the support 20 relative to the base 10 in the first type of motion. In one implementation, the first type of motion is substantially linear relative to the base 10, so that the seat 40, the hanger arm 30, and the support 20 move back and forth in opposite directions D1, D2 (see FIG. 1) that are substantially linear and/or parallel relative to the base 10.

The second drive mechanism 60 is coupled to the upper portion 24 of the support 20 and the hanger arm 30. The second drive mechanism 60 moves the seat 40 and the hanger arm 30 relative to the support 20 and the base 10 in the second type of motion. In one implementation, the second type of motion is substantially accurate relative to the base 10, so that the seat 40 and the hanger arm 30 move back and forth in opposite directions D3, D4 *see FIG. 1) that are substantially arcuate relative to the base 10. Thus, the support 20 moves in linear directions D1, D2 relative to the base 10 in the first type of motion, and the support 20 is substantially fixed relative to the base 10 in the second type of motion. In one embodiment, the hanger arm 30 is pivotally coupled to the upper portion 24 of the support 20, thereby permitting the seat 40 to swing back and forth in directions D3, D4.

Figure 3:
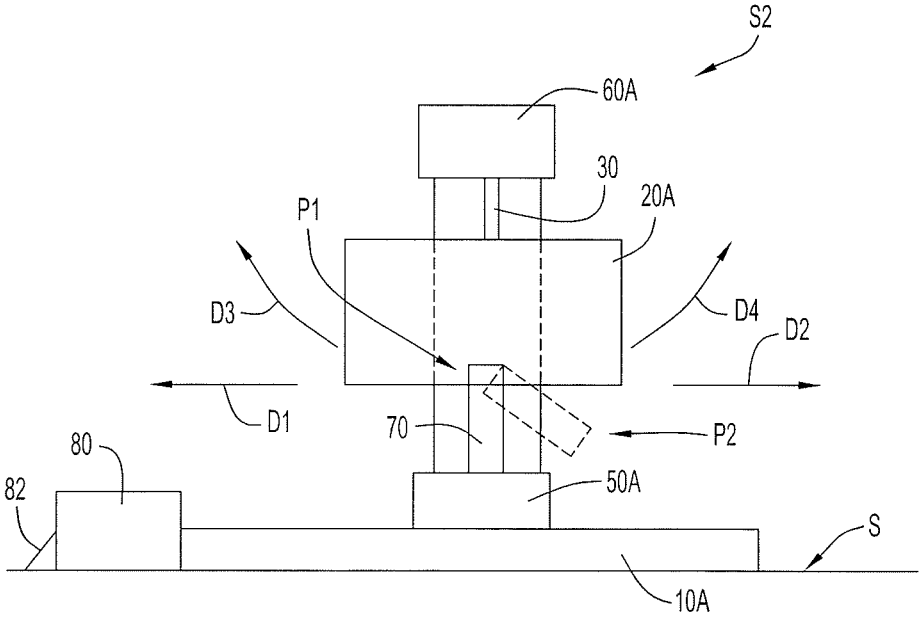
FIG. 3 illustrates a front view schematic diagram of an infant swing according to another embodiment.

FIG. 3 illustrates a schematic diagram of another embodiment of an infant swing S2. Swing S2 includes a base portion 10A configured to engage a support surface S, a seat portion 20A coupled to the base portion 10A and supported by a hanger arm 30, and a drive assembly having a first drive mechanism 50A and a second drive mechanism 60A. The seat portion 20A is movable relative to the base portion 10A in a gliding motion, back and forth in opposite directions D1, D2 that are substantially linear relative to the base portion 10A. The seat portion 20A is also movable relative to the base portion 10A in a swinging motion, back and forth in opposite directions D3, D4 that are substantially arcuate relative to the base portion 10A.

The first drive mechanism 50A is coupled to the base portion 10A, and moves the seat portion 20A in the gliding motion in directions D1, D2. The second drive mechanism 60A is coupled to the seat portion 20A, and moves the seat portion 20A in the swinging motion in directions D3, D4.

In one embodiment, the swing S2 includes a lock-out mechanism 70 movable between a deployed position P1 and a released position P2 (shown in phantom). When the lock-out mechanism 70 is in the deployed position P1, movement of the seat portion 20A is limited to the gliding motion in directions D1, D2. When the lock-out mechanism 70 is in the released position P2, the seat portion 20A is movable in the swinging motion in directions D3, D4.

The swing S2 may further include an input portion 80 operatively connected to the drive assembly. The input portion 80 includes at least one input mechanism, or input 82, configured to control the first drive mechanism 50A and/or the second drive mechanism 60A. In one implementation, the input portion 80 is removably coupled to the base portion 10A, and is disposed proximate to the support surface S and/or positioned relative to the support surface S so that a user can select and actuate the input 82 with a foot of the user. By positioning the input portion 80 at this location, the user can easily press one of the inputs and control the functions of the infant swing with a toe or foot, thereby allowing the use of both hands of the user for a different function, such as carrying an object or tending to an infant in the swing.

Figure 4:
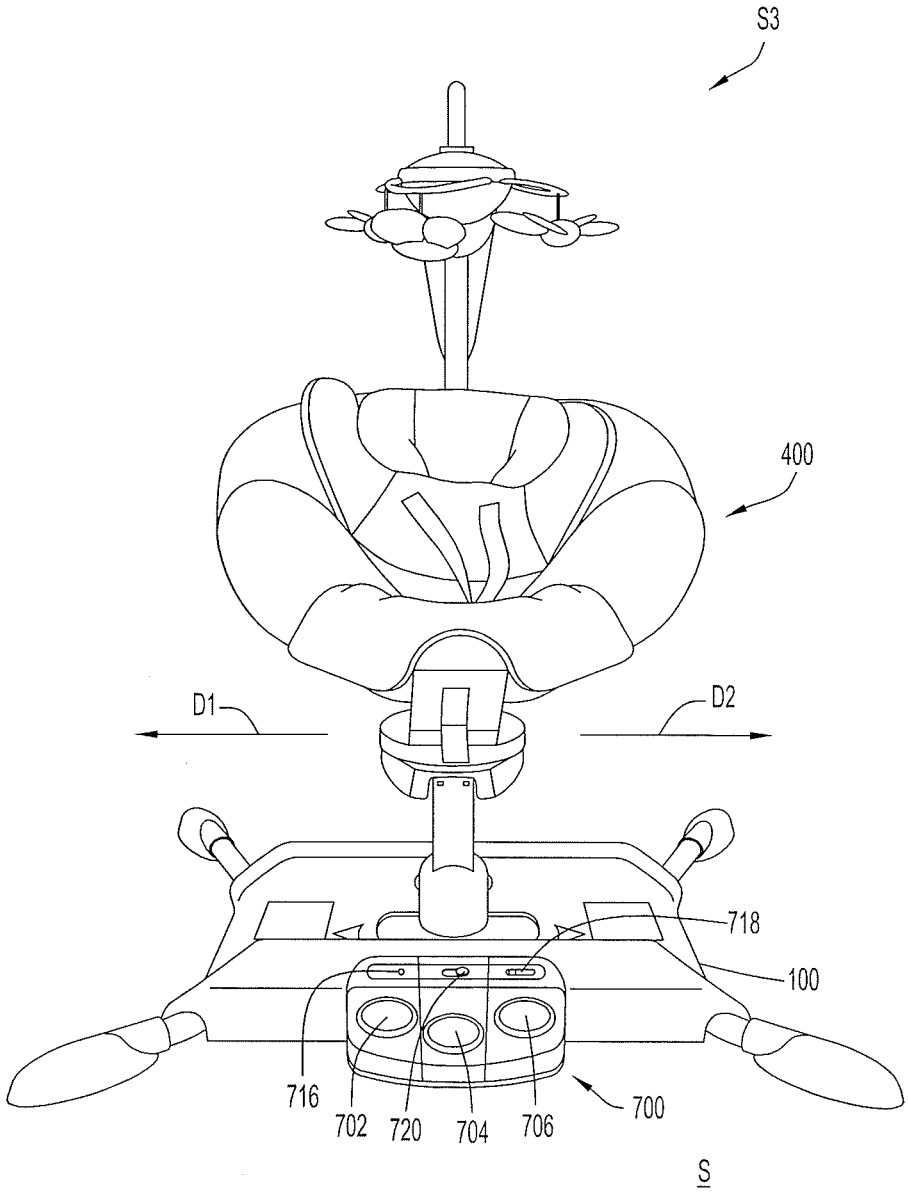
FIG. 4 illustrates a front perspective view of an infant swing according to another embodiment showing a mode lever in a deployed position.
Figure 5:
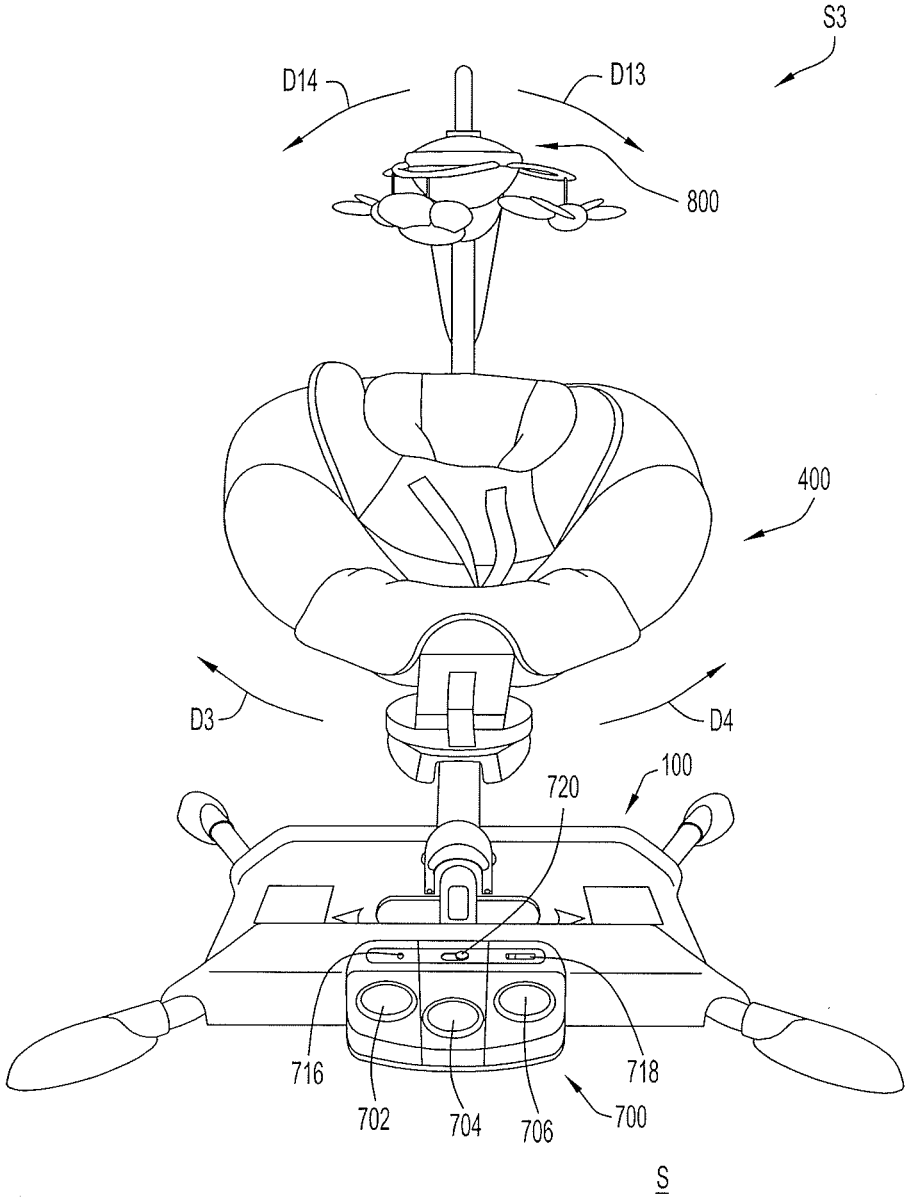
FIG. 5 illustrates another front perspective view of the infant swing of FIG. 4 showing the mode lever in a released position.
Figure 6:
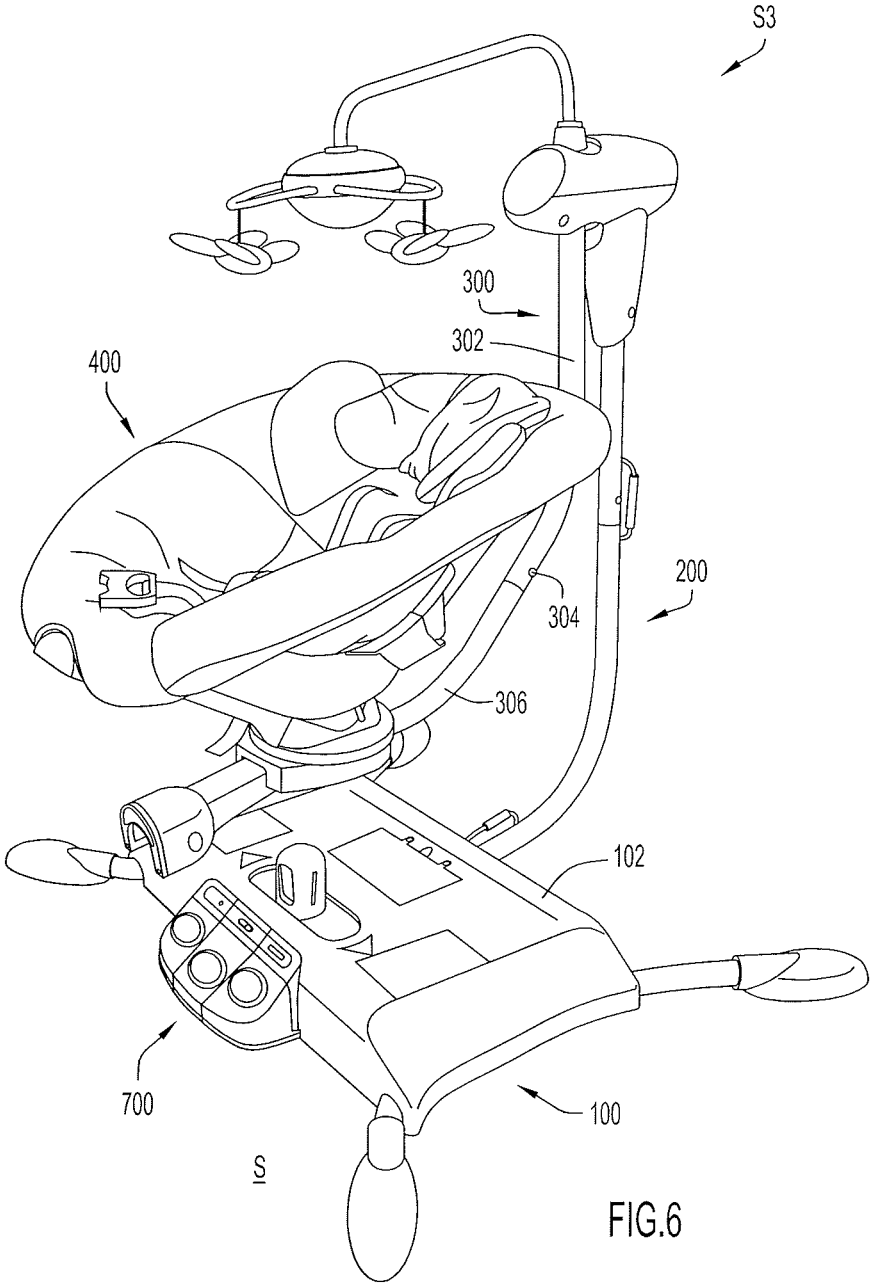
FIG. 6 illustrates a side perspective view of the infant swing of FIG. 4 showing the mode lever in the released position.

FIGS. 4-26 illustrate an infant swing S3 according to another embodiment. Referring to FIGS. 4-6, swing S3 includes a base portion 100 configured to be supported by a support surface S, a support 200 extending upwardly from the base 100 (see FIG. 6), an arm 300 coupled to the support 200, and a seat portion 400 coupled to the arm 300. In this embodiment, the swing S3 includes a mobile 800. The seat portion 400 is configured to receive and support an infant. Swing S3 further includes a drive system (described in detail below) configured to move the arm 300 relative to the base 100, and an actuator 700 operatively coupled to the drive system. The actuator 700 is located proximate to the support surface S so that a user can engage the actuator 700 with the user's foot to control the drive system.

Figure 7:
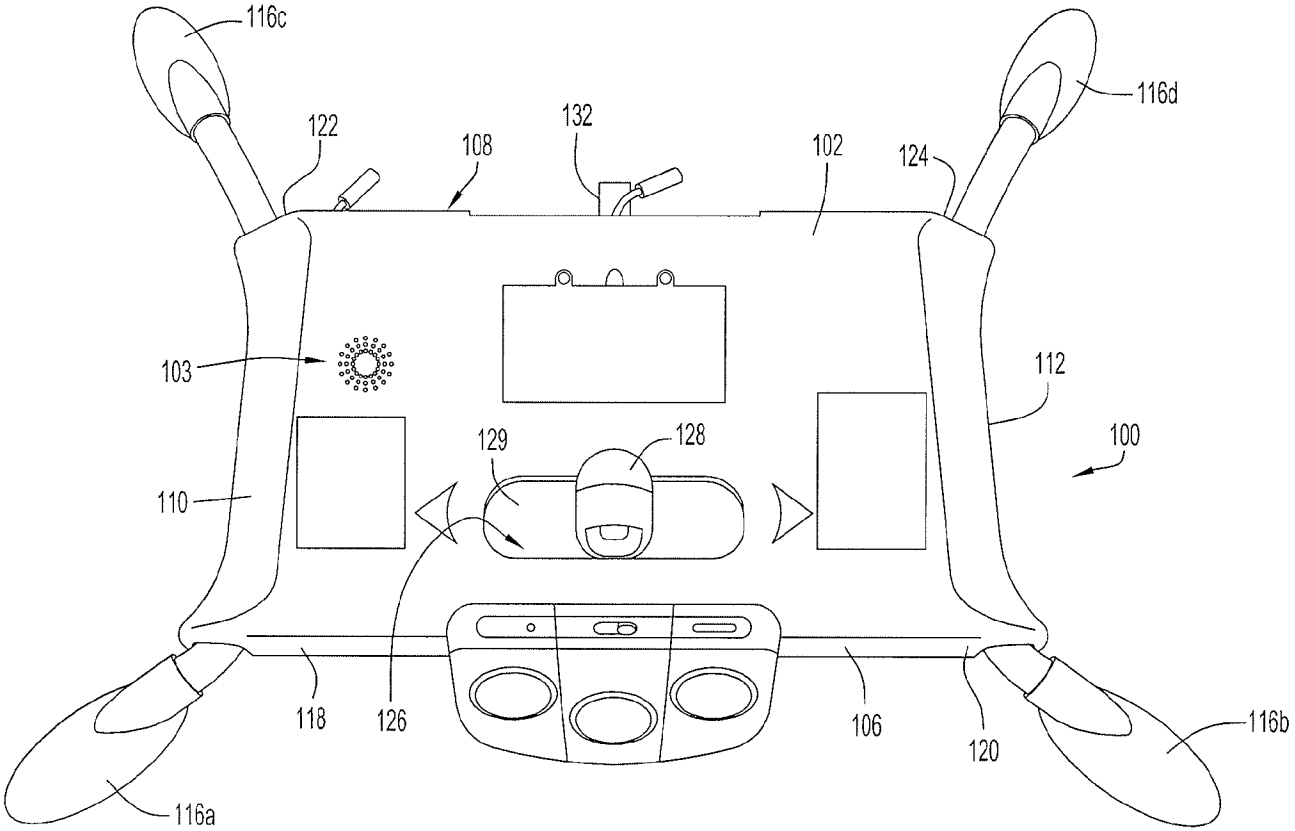
FIG. 7 illustrates a top perspective view of a base of the infant swing of FIG. 4.
Figure 8:
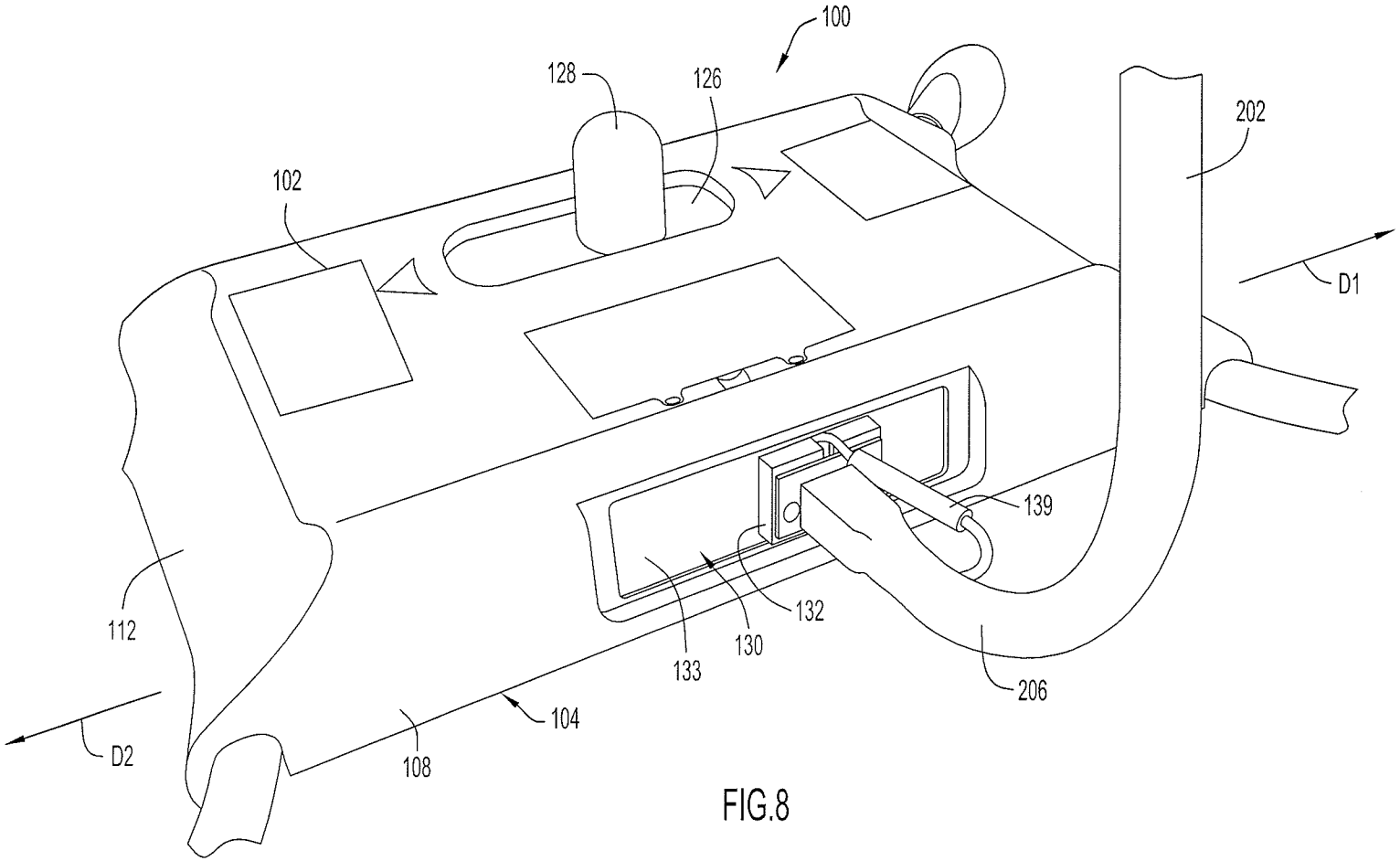
FIG. 8 illustrates a rear perspective view of the base of FIG. 7.

Referring to FIGS. 7 and 8, the base 100 includes a substantially planar upper surface 102, a lower surface 104, a front wall 106 and opposite rear wall 108, and opposite side walls 110, 112. Front wall 106, rear wall 108, and side walls 110, 112, extend between and connect the upper surface 102 and the lower surface 104. In this embodiment, the upper surface 102 includes several holes formed therein defining a speaker area 103 through which audible outputs may be heard. The base 100 defines an interior cavity 114 (shown in FIG. 20), which houses portions of a drive system or mechanism 500. In one embodiment, the base 100 includes foot members 116*a*, 116*b* extending outwardly from opposing ends 118, 120 of the front wall 106, and foot members 116*c*, 116*d* extending outwardly from opposing ends 122, 124 of the rear wall 108. Foot members 116*a*, 116*b*, 116*c*, 116*d* help to stabilize the base 100, and thus the swing S3, on the support surface S. The foot members 116*a-d* are coupled to bars that are connected to the base 100.

The upper surface 102 of base 100 defines a slot 126, which in this embodiment is proximate to the front wall 106. A coupling mechanism 128 is slidably disposed within the slot 126 of the base 100, and movable between opposing ends thereof via actuation of the drive mechanism 500, as described in further detail below. A guard member 129 is disposed around and movable with the coupling mechanism 128 within the slot 126, so that any undesirable objects are blocked access to the slot 126 (e.g. fingers, toes, toys, food, etc.).

As shown in FIG. 8, the rear wall 108 of the base 100 defines another slot 130. An extension member 132 is slidably disposed within the slot 130, and movable between opposing ends thereof via actuation of the drive mechanism 500. Another guard member 133 is disposed around and movable with the extension member 132 within the slot 130, so that any undesirable objects are blocked access to the slot 130. The range of motion of the coupling mechanism 128, or the distance that the coupling mechanism 128 moves between the opposing ends of the slot 126, is substantially equal to the range of motion of the extension member 132 between opposing ends of the slot 130.

Figure 9:
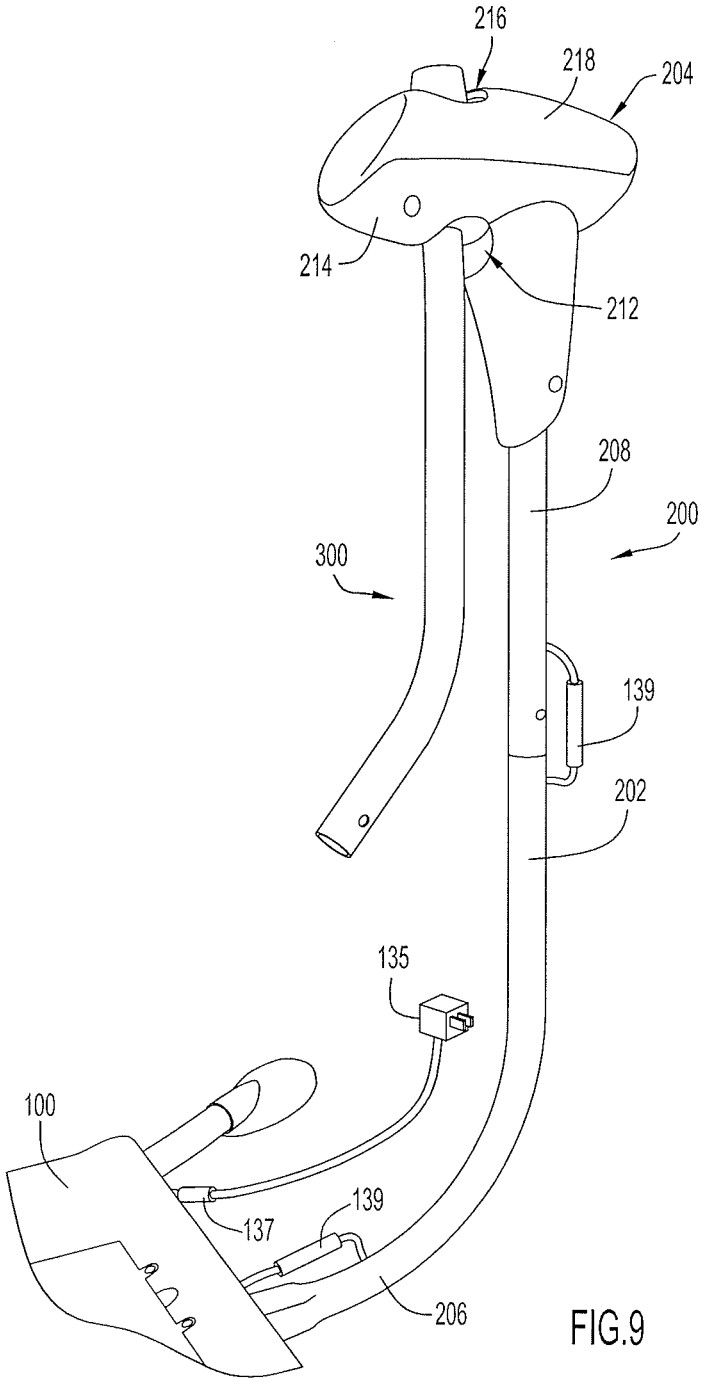
FIG. 9 illustrates a perspective view of a support and portions of the hanger arm of the infant swing of FIG. 4.

Referring to FIGS. 8 and 9, the support 200 includes a support post 202 and an upper housing assembly 204. The support post 202 includes a lower end 206 coupled to the extension member 132 and the drive mechanism 500, and an opposite upper end 208 coupled to the upper housing assembly 204. The support 200 is movable relative to the base 100 via actuation of the drive mechanism 500.

In one mode of use, the swing S3 may be operated using batteries. Alternatively, the swing S3 may be operated using an external power source. As shown in FIGS. 8 and 9, the base 100 includes a port or jack 137 that is accessible outside of the base. A power cord with an adapter 135 configured to be plugged into an external power system, such as in a house or other structure, can be coupled to the jack 137. Both of the batteries and the external power is connected to the drive mechanism 500 located in the base 100. The swing S3 includes a cable or wiring 139 that connects the power source to the drive mechanism 600 in the upper portion 124 of the support 120. As shown in FIG. 9, the support 200 may include multiple tubular components that are coupled together and retained in position using resilient members such as Valco tabs. At the junction of adjacent tubular components, the cable is connected around the junction and directly connected to the tubular components as shown. This arrangement allows for the tubular components to be disconnected while having sufficient play or flexibility in the cable 139 to allow the support 120 to be collapsed for transportation or storage. The portions of the cable 139 from the base 100 to the upper portion 124 that are not visible in FIGS. 8 and 9 are otherwise located within the tubular components.

Figure 10:
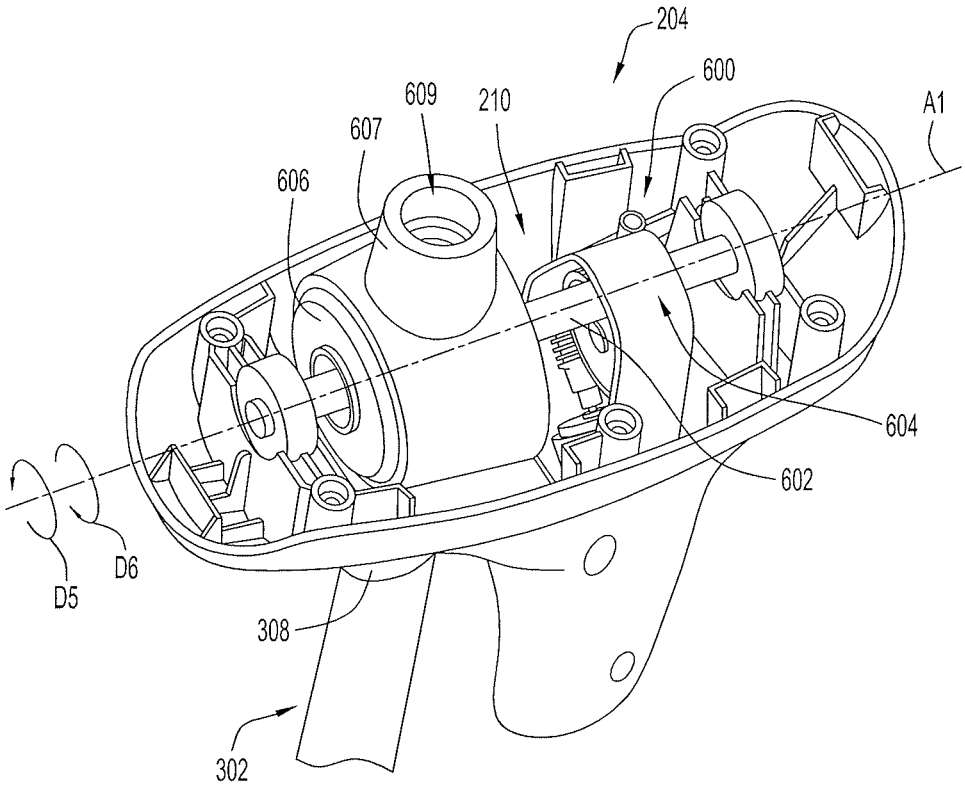
FIG. 10 illustrates a perspective view of components of a drive mechanism in a cavity of an upper housing assembly of the support.

Referring to FIGS. 9 and 10, the upper housing assembly 204 defines a cavity 210 configured for housing drive mechanism 600. A slot 212 is disposed in an underside 214 of the upper housing assembly 204. Another slot 216 is disposed in an upper side 218 of the upper housing assembly 204, and aligned with the slot 212 in the underside 214.

The drive mechanism 600 includes an axle 602 rotatable about its longitudinal axis A1 in first and second opposite directions D5, D6 via actuation of a motor 604 operatively coupled thereto. A drum 606 is disposed within the cavity 210 and connected to the axle 602, and thus rotatable therewith in directions D5, D6. The drum 606 is aligned with the slots 212, 216. The drum 606 has a boss 607 integrally formed therewith that extends out through slot 216. The boss 607 includes an opening or receptacle 609 formed therein as shown in FIG. 10. The upper end of arm 300 is inserted into the slot 212 and an opening formed in the lower surface of the drum 606.

Referring to FIGS. 6 and 10, the arm 300 includes an upper section 302, a central section 304, and a lower section 306. The upper section 302 includes an end portion 308 extending through the slot 212 and connected to the drum 606. Thus, the arm 300 is movable in a swinging motion as the drum 606 is rotated in directions D5, D6 via the drive mechanism 600.

Figure 11:
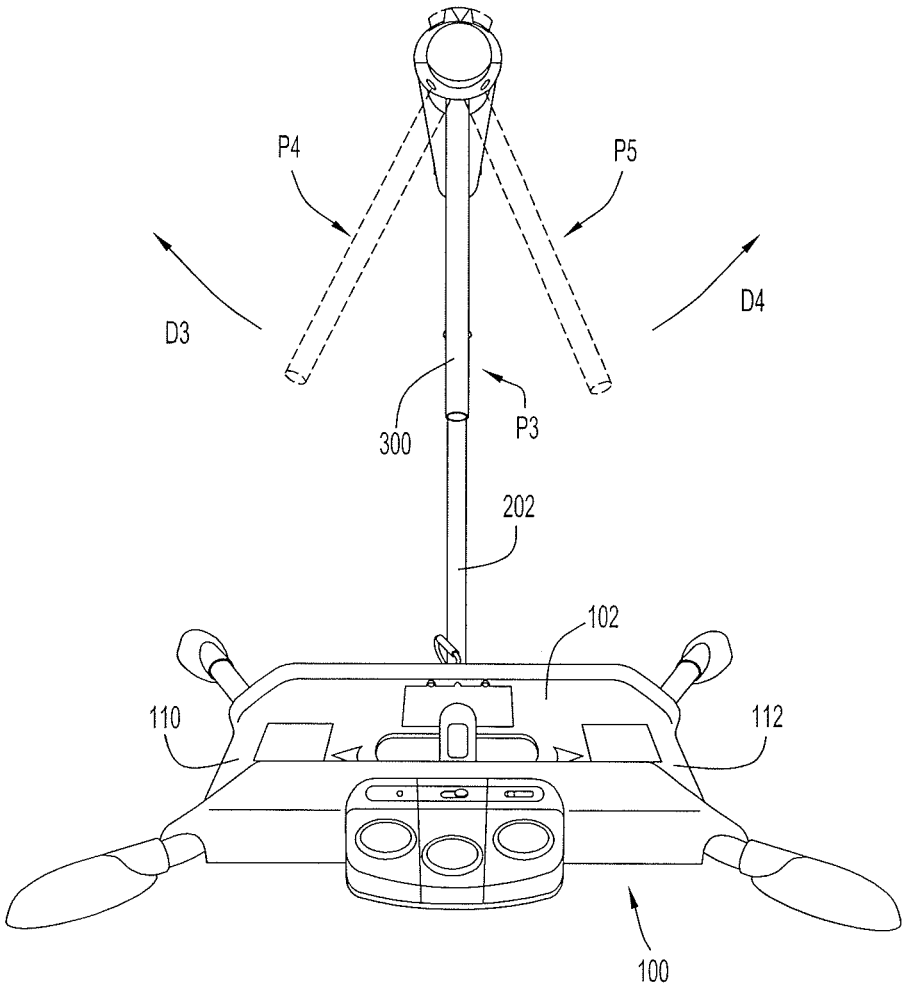
FIG. 11 illustrates a front perspective view of the base, the support, and portions of the hanger arm, and showing alternative positions of the hanger arm in phantom.

Referring to FIG. 11, the arm 300 is movable from a central position P3 along an arcuate path in direction D3 away from support post 202 and in the direction of sidewall 110 of the base 100 to a position P4 (shown in phantom). The arm 300 is then movable from position P4 back toward and through the central position P3 in direction D4, and in the direction of the opposing sidewall 112 of the base 100 to a position P5 (shown in phantom).

In one embodiment and referring to FIGS. 6 and 11, the upper section 302 of the arm 300 is substantially parallel to the support post 202 when the arm 300 is in the central position P3, the central section 304 extends outwardly from and is angularly oriented relative to the support post 202, and the lower section 306 extends outwardly from and is substantially perpendicular to the support post 202. Thus, the lower section 306 of the arm 300 is spaced from the support 200 and is disposed above the upper surface 102 of the base 100.

Figure 12:
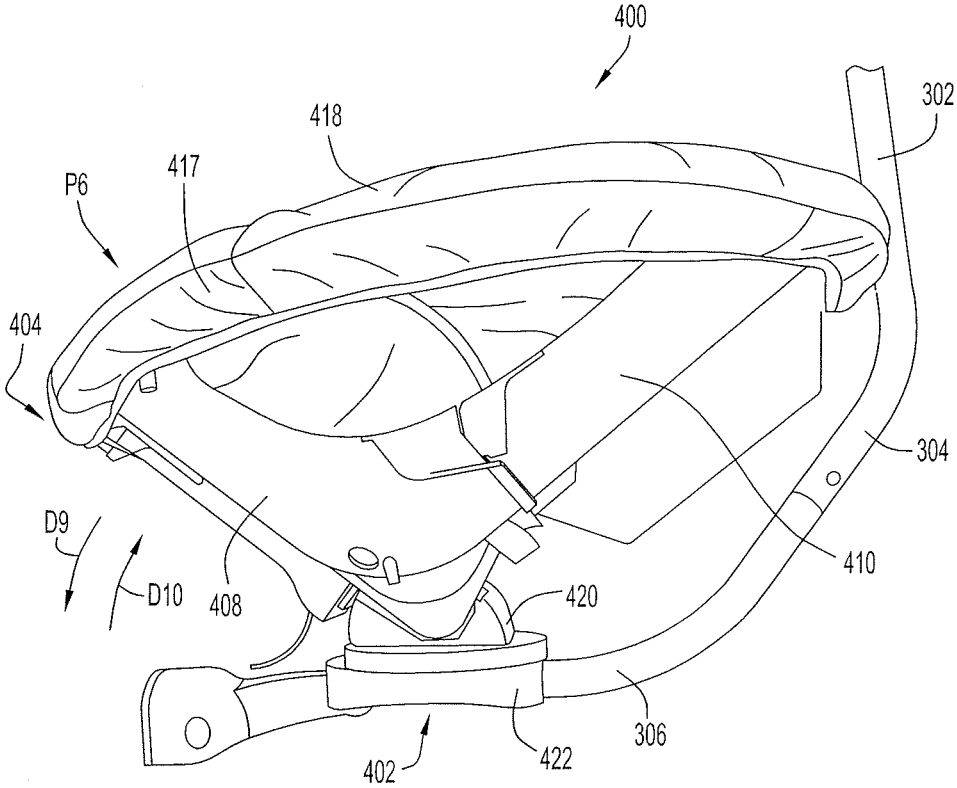
FIG. 12 illustrates a side perspective view of the hanger arm and seat portion of the infant swing of FIG. 4 showing the seat portion in a first position.
Figure 13:
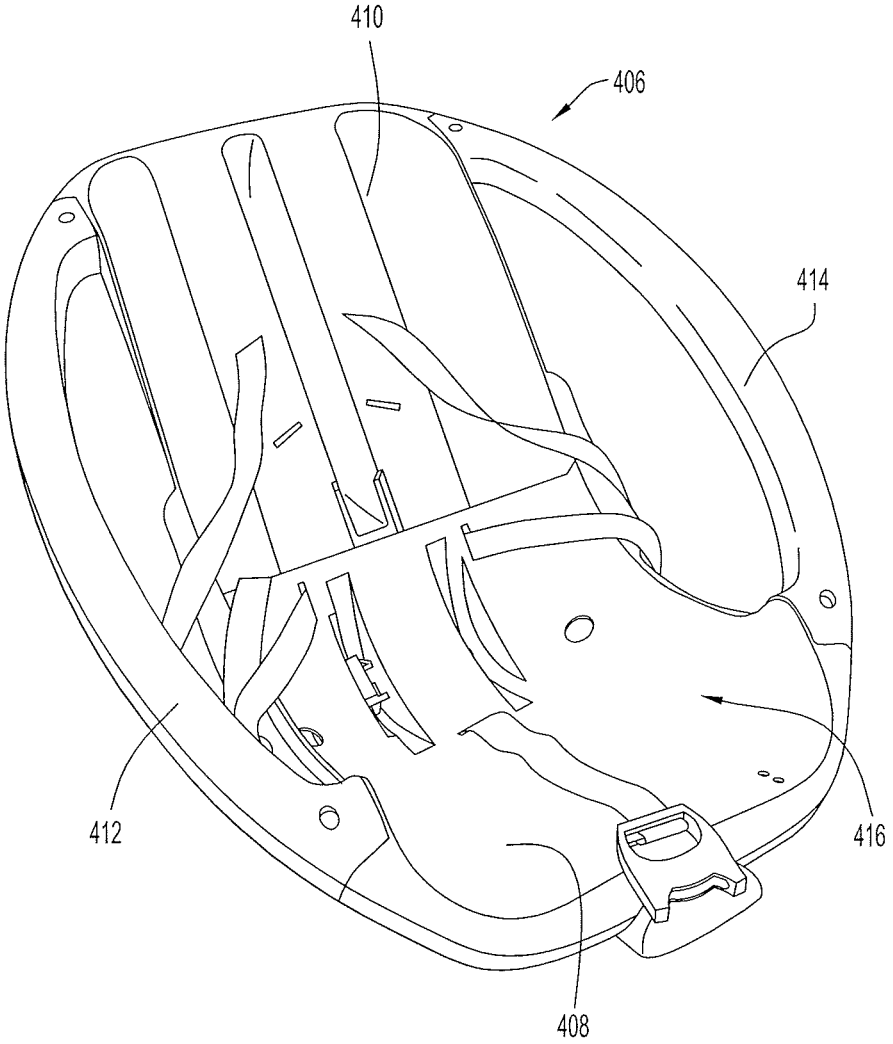
FIG. 13 illustrates a front perspective view of a frame of the seat portion.

Referring to FIGS. 12 and 13, the seat portion 400 includes a pedestal 402 and a seat 404 coupled to the pedestal 402. In one embodiment, the seat 404 includes frame 406 having a bottom portion 408, a back portion 410, and arm rests or side portions 412, 414 (see FIG. 13). The frame 406 defines a receiving area or receptacle 416 configured to receive and support an infant therein. A flexible material, such as a soft-goods or fabric material 418, may be coupled to the frame 406 and disposed within the receiving area 416, providing a comfortable and soft seating surface for an infant. In one embodiment, the fabric material 418 is removably coupled to the frame 406 to allow for washing of the fabric material 418. For example, the fabric material 418 may have a generally oval and concave configuration that fits within the receiving area 416, with an elastic peripheral edge portion 417 that may be stretched over and around the side portions 412, 414. In addition or alternatively, other fastening mechanisms may be provided for releasably securing the fabric material 418 to the frame 406, such as snaps, clips, elastic straps, etc.

Figure 14:
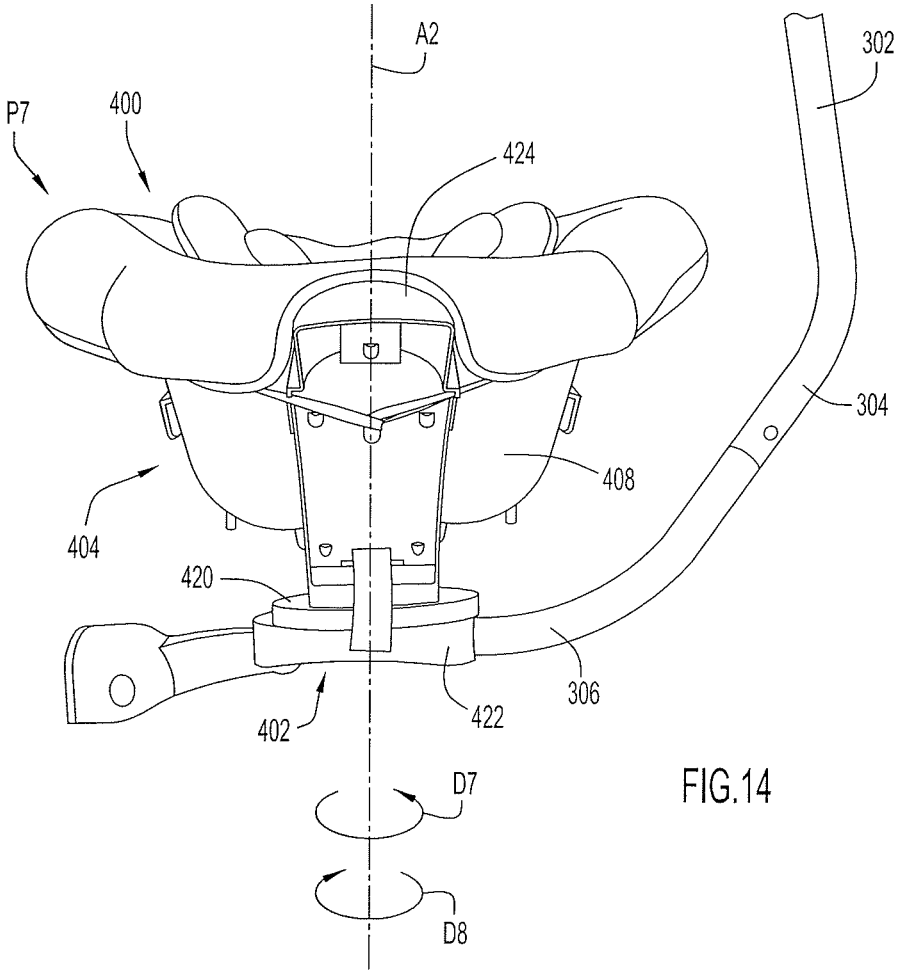
FIG. 14 illustrates a side perspective view of the hanger arm and seat portion of the infant swing of FIG. 4 showing the seat portion in a second position.

Referring to FIGS. 12 and 14, the lower section 306 of the arm 300 is coupled to the pedestal 402 of the seat portion 400. Thus, as the arm 300 swings back and forth in directions D3, D4 and between positions P4, P5 (as shown in FIG. 11), the seat portion 400 moves in a swinging motion relative to the base 100 and along an arcuate path in directions D3, D4. In one embodiment, the pedestal 402 includes an upper member 420 movably coupled to a lower member 422, and rotatable about an axis A2 in opposite directions D7, D8. The seat 404 is coupled to the upper member 420, and thus is likewise rotatable about axis A2 and movable in directions D7, D8. The seat 404 may be oriented in a forward facing position P6 (shown in FIG. 12) for a side-to-side swinging motion, or rotated about axis A2 to a side facing position P7 (shown in FIG. 14) for a head-to-toe swinging motion.

In one embodiment, the seat 404 is pivotally coupled to the upper member 420, so that the incline of the frame 406 may also be adjusted. For example, a handle 424 may be slidably coupled to the bottom portion 408 of the frame 406. The handle 424 is connected to a latch, which is received in a selected one of a plurality of openings in the upper member 420. Pulling the handle 424 outwardly releases the latch from the opening, allowing the seat 404 to be pivoted in a direction D9 (see FIG. 12) for inclining the seat 404, or in an opposite direction D10 for reclining the seat 404. When the handle 424 is released and/or pushed inwardly, the latch is biased back into an associated opening in the upper member 420 of the pedestal 402 corresponding to a selected incline (or decline) position, thereby maintaining the seat 404 in the selected incline (or decline) position.

Figure 15:
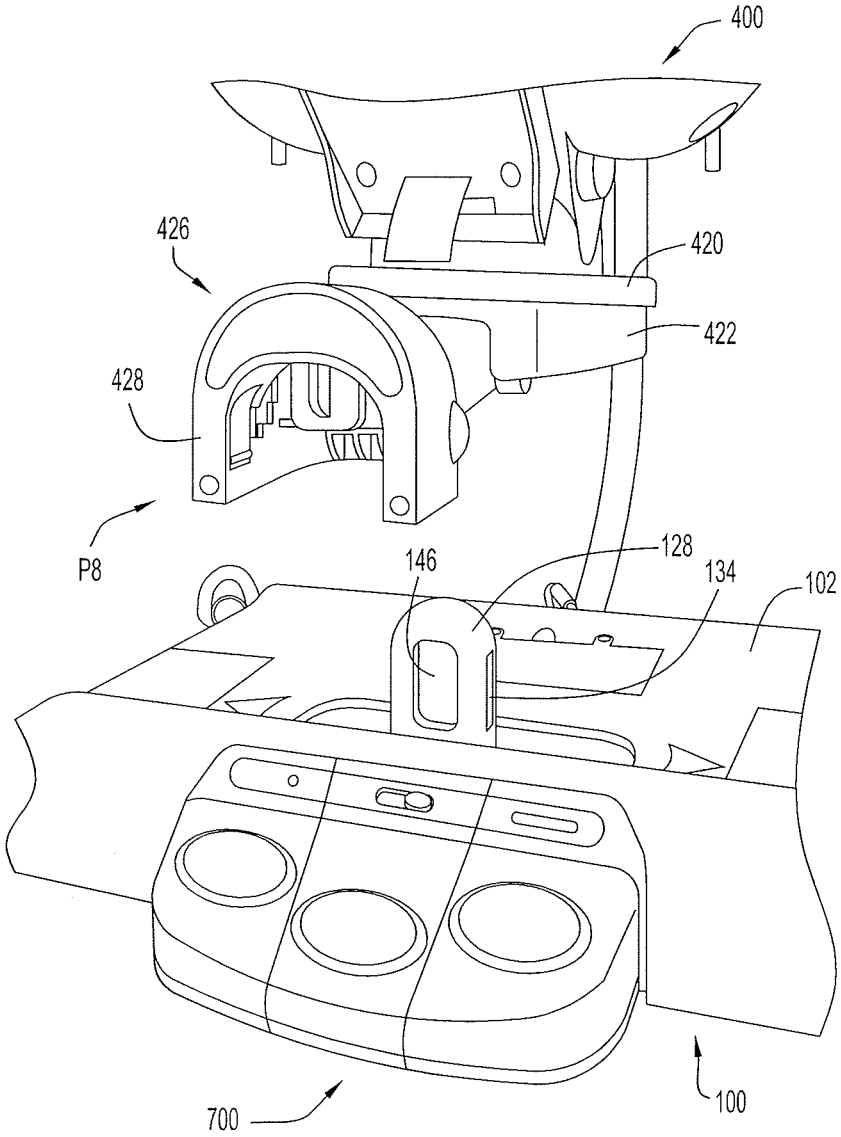
FIG. 15 illustrates a partial perspective view of the base and the seat portion showing the mode lever in a released position.
Figure 16:
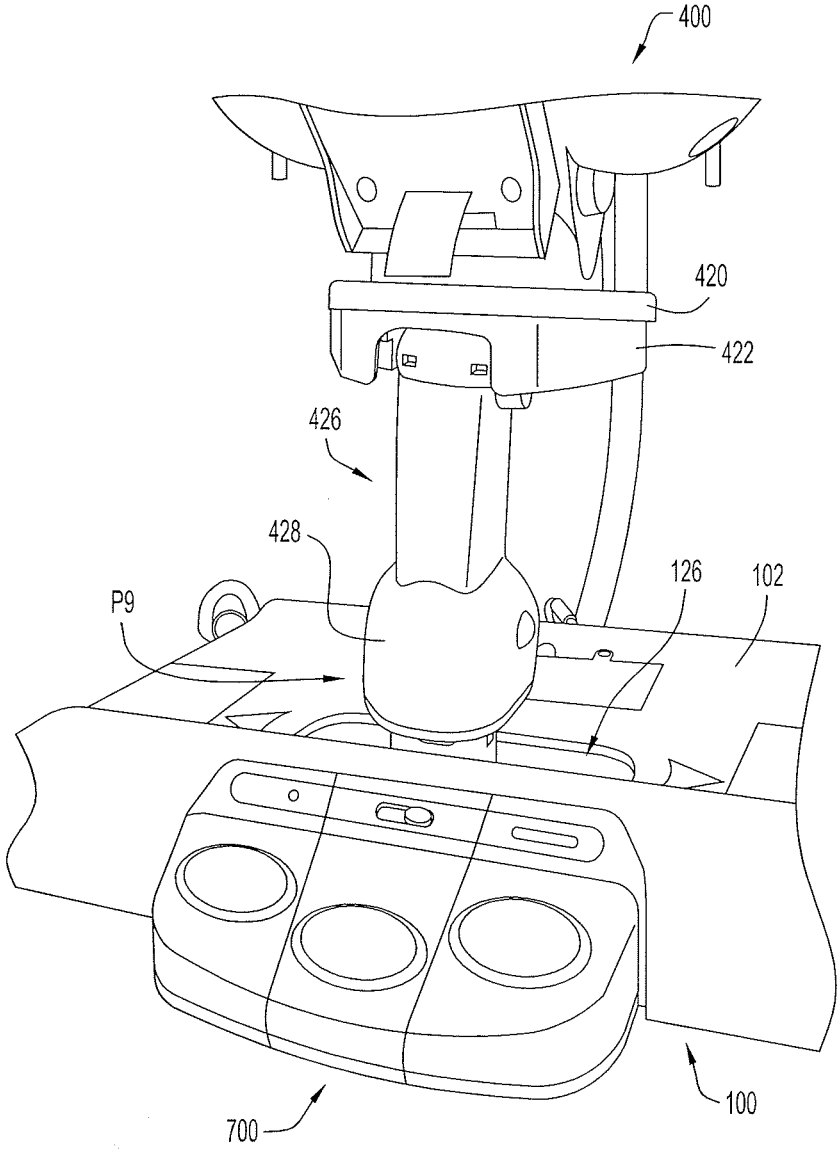
FIG. 16 illustrates a partial perspective view of the base and the seat portion showing the mode lever in a deployed position.

Referring to FIGS. 15 and 16, the seat portion 400 includes a mode mechanism or lever 426, which is pivotally connected to the lower member 422 of the pedestal 402. The mode lever 426 includes a coupling mechanism or portion 428 on a distal end thereof, which is configured to releasably engage the coupling mechanism 128 within the slot 126 of the base 100. Thus, the mode lever 426 is movable between a released position P8 whereby the coupling mechanism 428 is disengaged from the coupling mechanism 128 on the base 100 (shown in FIG. 15), and a deployed position P9 whereby the coupling mechanism 428 is engaging the coupling mechanism 128 (shown in FIG. 16). In the deployed position P9, the seat portion 400 is coupled to the drive mechanism 500 and also to the support 200 via the engagement of coupling mechanisms 128, 428 because the support 200 is connected to coupling mechanism 128.

Figure 17:
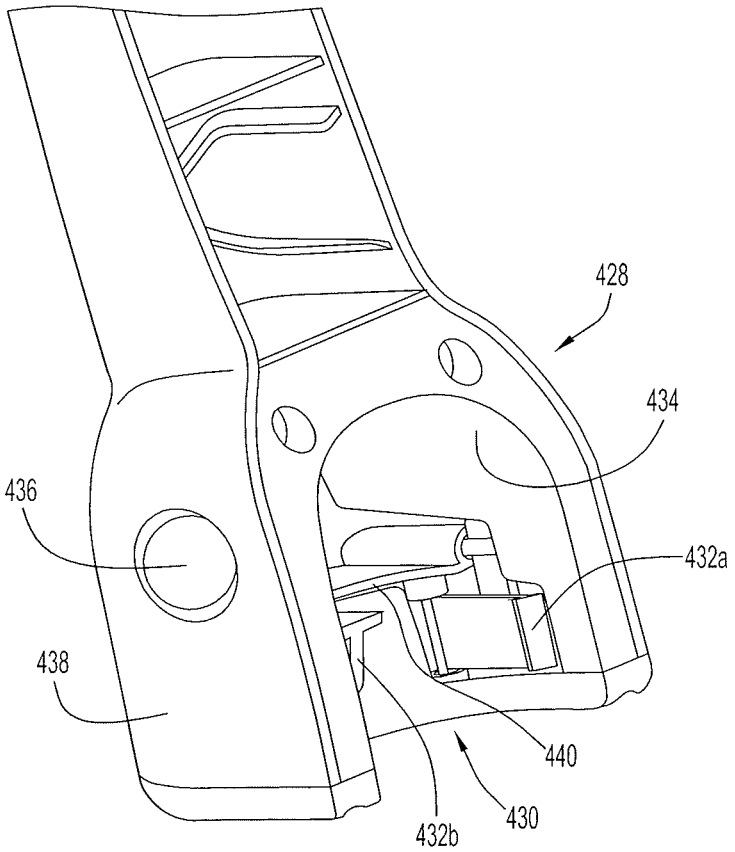
FIG. 17 illustrates a partial perspective view of the mode lever showing the coupling mechanism of the mode lever.

Referring to FIG. 17, the coupling mechanism 428 includes a recess 430 in which the coupling mechanism 128 is received. Lock tabs 432*a*, 432*b* are disposed on an inner surface 434 of the coupling mechanism 428 defining the recess 430. The lock tabs 432*a*, 432*b* are biased into the recess 430, and engage corresponding configured indentations 134 on opposite sides of coupling mechanism 128 (only one of which is shown in FIG. 15) when the mode lever 426 is in the deployed position P9. Release buttons 436 are disposed on an outer surface 438 of the coupling mechanism 428. The release buttons 436 are operatively associated with the lock tabs 432*a*, 432*b*. Depression of the release buttons 436 releases the lock tabs 432*a*, 432*b* from engagement within the indentations 134, thereby permitting the mode lever 426 to be moved to its released position P8. In one embodiment, the mode lever 426 is biased toward the released position P8, such by a spring, so that upon actuation of the release buttons 436, the mode lever 426 automatically pivots upwardly toward its released position P8. The mode lever 426 is then maintained in its released position P8 via the force of the spring, until it is again manually pivoted downwardly by a user, so that it can engage coupling mechanism 128.

Figure 18:
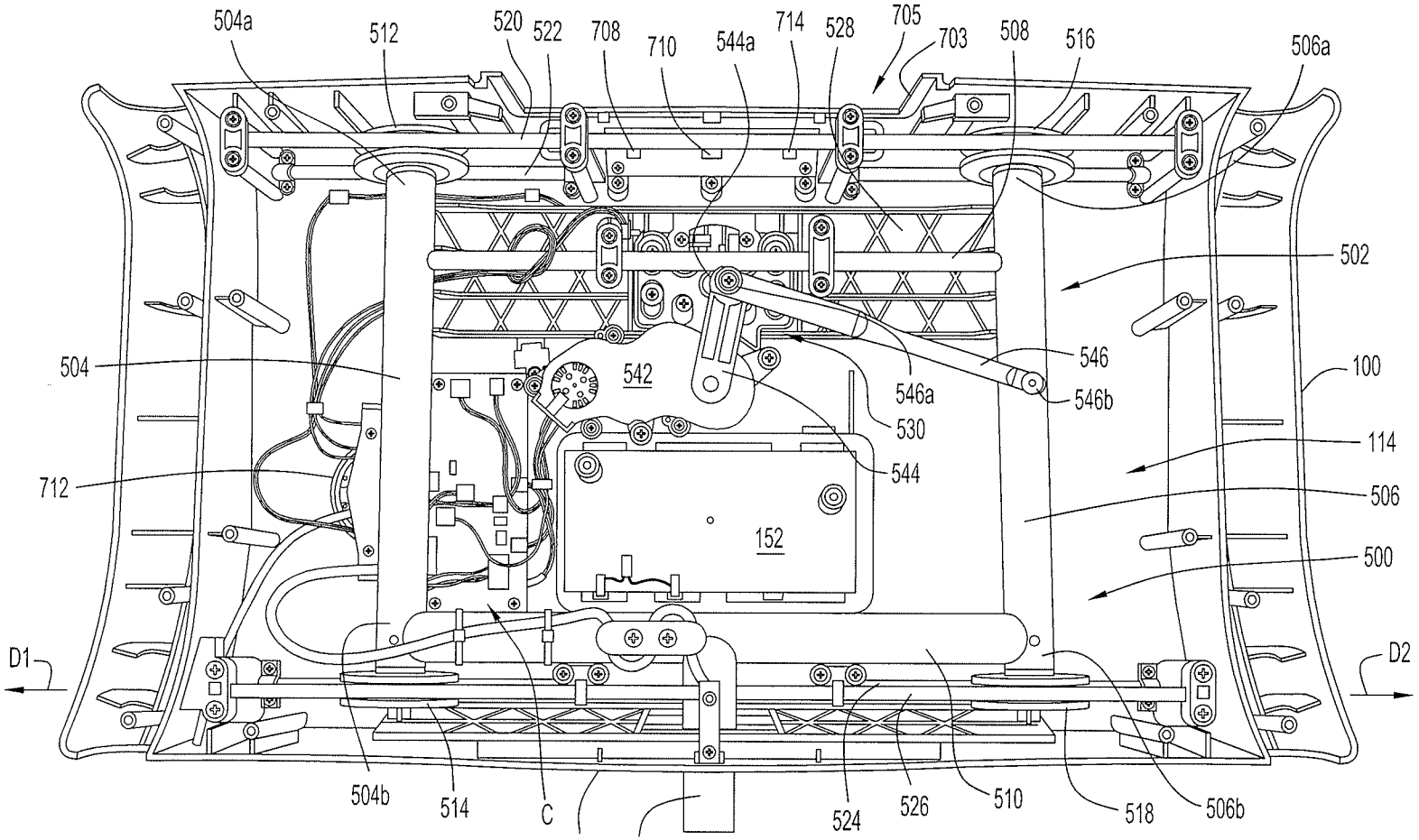
FIG. 18 illustrates a perspective view of the base, viewed from the bottom and showing components of the drive mechanism within the cavity of the base.

As described above, the coupling mechanism 128 is slidably disposed within the slot 126 of the base 100, and movable between opposing ends thereof via actuation of the drive mechanism 500. Referring to FIG. 18, the drive mechanism 500 includes a carrier assembly 502 movably disposed within the cavity 114 defined by the base 100.

In one embodiment, the carrier assembly 502 includes a tubular frame having spaced side members 504, 506 and opposing end members 508, 510, which are coupled together to have a substantially rectangular configuration. A wheel 512 is rotatably coupled to an end portion 504*a* of the side member 504, and another wheel 514 is rotatably coupled to an opposite end portion 504*b* of the side member 504. Similarly, wheels 516, 518 are rotatably coupled to opposite end portions 506*a*, 506*b* of side member 506, respectively. Wheels 512, 516 are movably retained between spaced upper and lower front rails 520, 522, and wheels 514, 518 are movably retained between spaced upper and lower rear rails 524, 526. The carrier assembly 502 is linearly movable in opposite directions D1, D2 as the wheels 512-518 roll along the respective front rails 520, 522 and rear rails 524, 526. The carrier assembly 502 also includes a support plate 528 connected to and extending between the side members 504, 506 proximate to ends 504*a*, 506*a* thereof. The support plate 528 is movable with the carrier assembly 502 along directions D1, D2.

Figure 19:
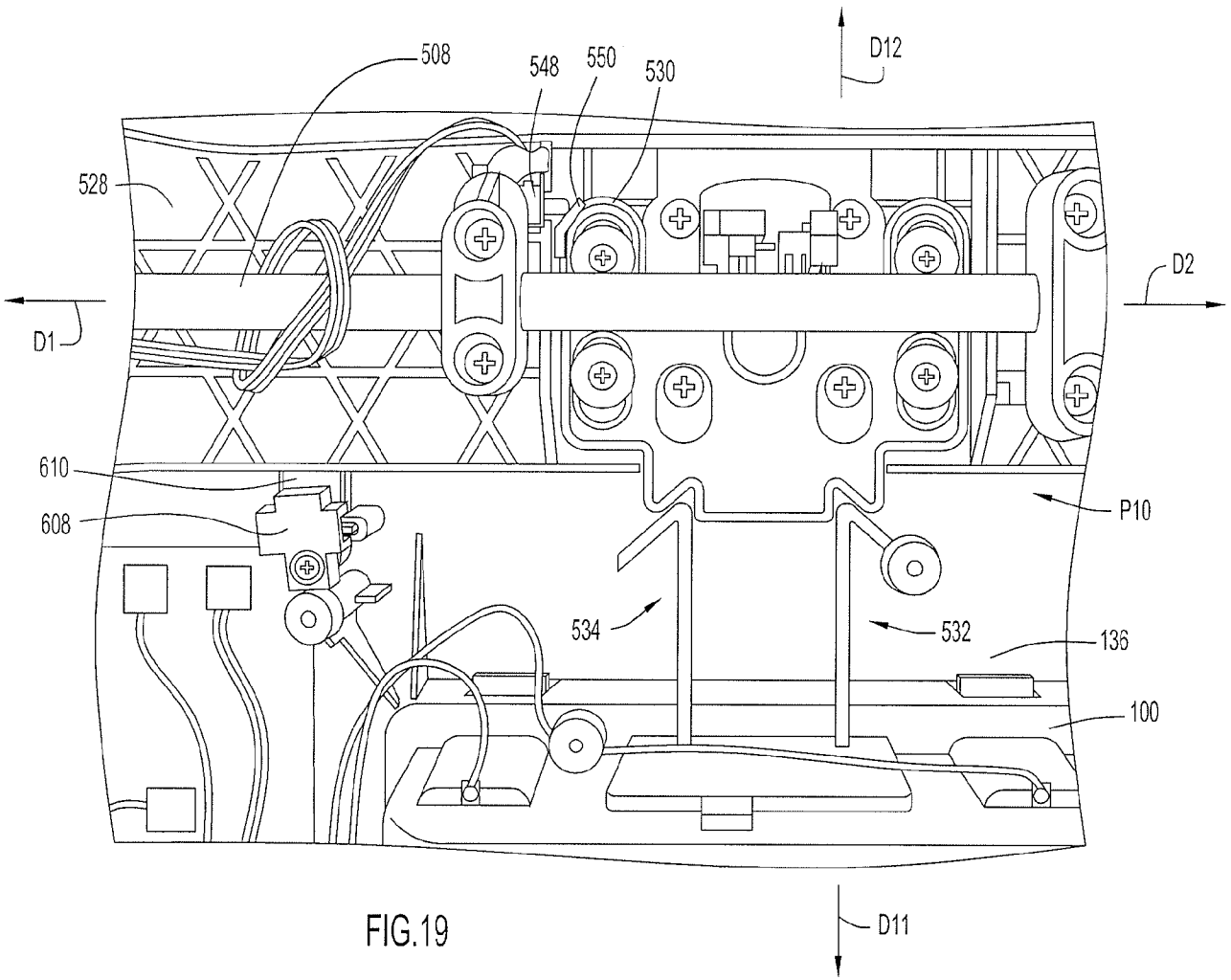
FIG. 19 illustrates a top perspective view of portions of the drive mechanism within the cavity of the base, showing a lock plate in a locked position.
Figure 20:
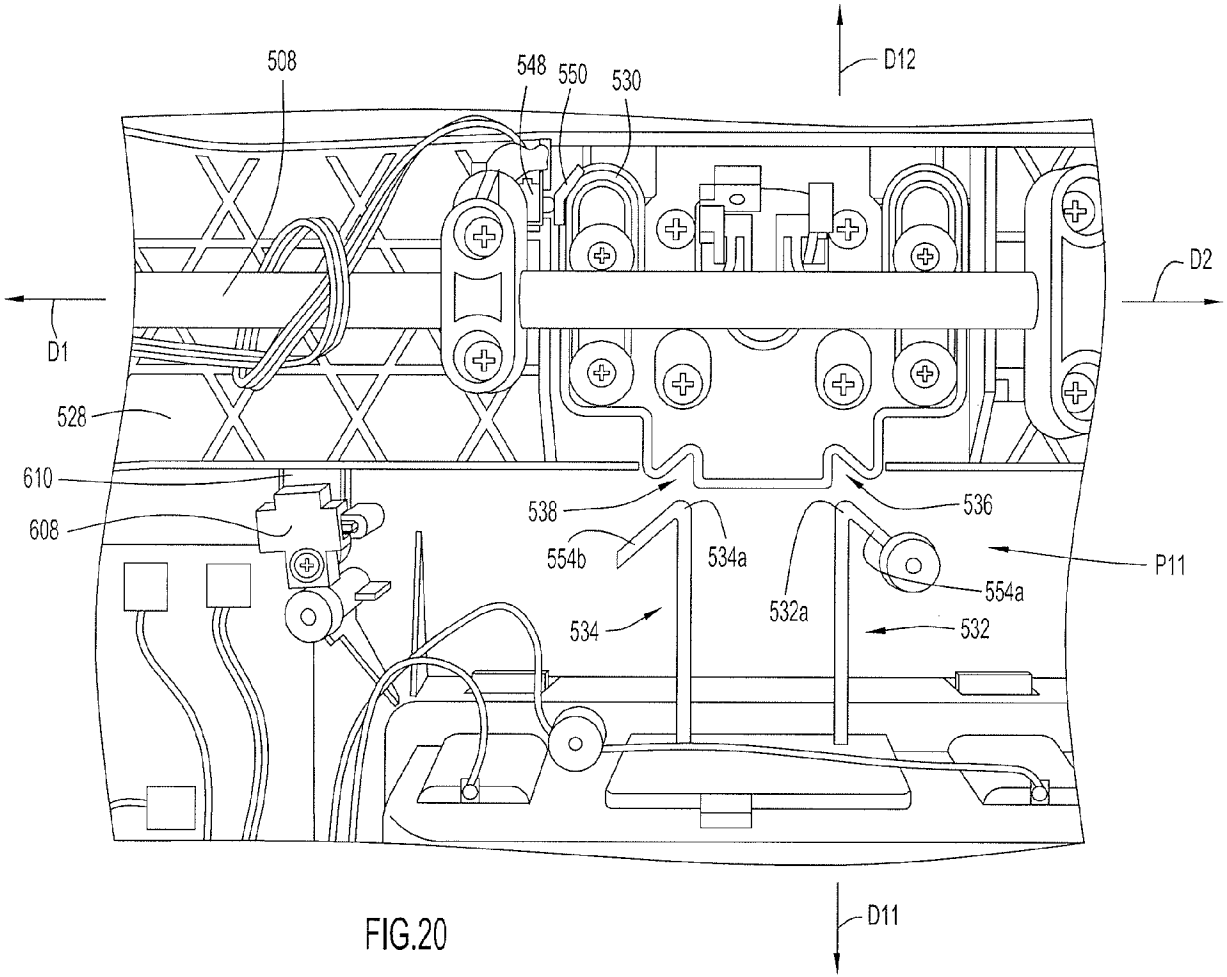
FIG. 20 illustrates a top perspective view of portions of the drive mechanism within the cavity of the base, showing the lock plate in a released position.

Referring to FIGS. 19 and 20, a lock plate 530 is carried by and slidably connected to the support plate 528. The lock plate 530 is movable between a locked position P10 engaging stops 532, 534 formed in or coupled to an inner surface 136 of the base 100, as shown in FIG. 19, and a released position P11 disengaged from stops 532, 534, as shown in FIG. 20. In one embodiment, the lock plate 530 includes indents 536, 538, which receive correspondingly configured projection portions 532*a*, 534*a* of stops 532, 534, respectively.

The lock plate 530 is movable in a direction D11 toward the stops 532, 534, and an opposite direction D12 away from the stops 532, 534. In one embodiment, directions D11, D12 are substantially perpendicular to the directions D1, D2 in which the carrier assembly 502 moves. In the locked position P10 (see FIG. 10), the lock plate 530 is engaging the stops 532, 534 and movement of the carrier assembly 502 relative to the base 100 is restricted. In the released position P11, the lock plate 530 is disengaged from the stops 532, 534 and movement of the carrier assembly 502 in directions D1, D2 is permitted.

Figure 21:
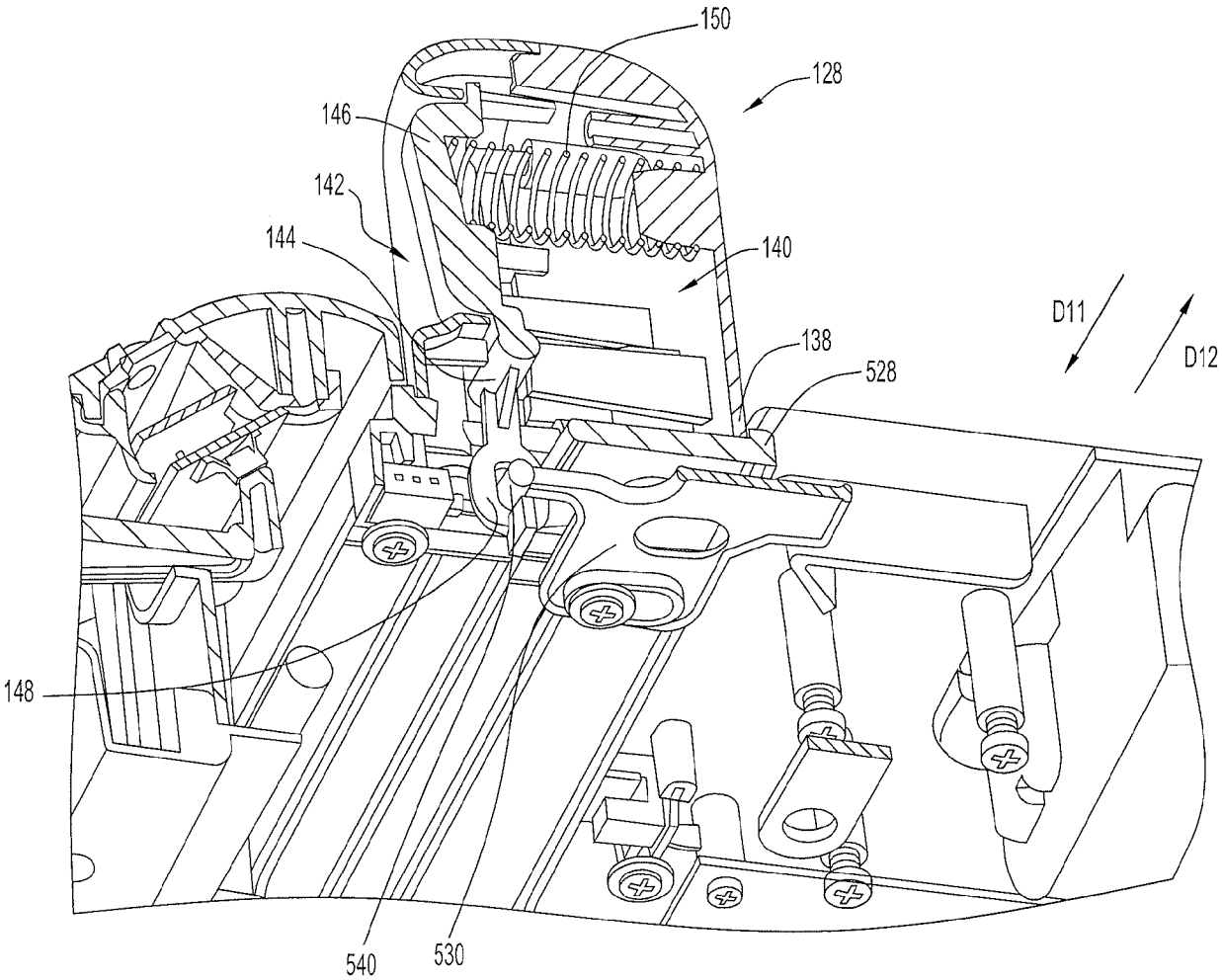
FIG. 21 illustrates a sectional perspective side view of the base showing the coupling mechanism of the base.

Referring to FIG. 21, the coupling mechanism 128 includes a lower portion 138 that extends through the slot 126 and is coupled to the support plate 528. The coupling mechanism 128 defines an internal cavity 140 and an opening 142 in communication with the cavity 140. A latch arm 144 is pivotally mounted within the cavity 140. The latch arm 144 includes an upper end 146 disposed within the opening 142, and a lower end 148 coupled to the lock plate 530. In one embodiment, the lower end 148 is pivotally coupled to a catch 540 provided on the lock plate 530.

The upper end 146 of the latch arm 144 is biased outwardly and within the opening 142 in the coupling mechanism 128 via a resilient member, such as a spring 150. Thus, the lower end 148 of the latch arm 144 pushes against the catch 540, so that the lock plate 530 is biased in direction D11 and toward the locked position P10 (shown in FIG. 19) via the spring 150. When the upper end 146 is pushed inwardly toward the cavity 140, thereby compressing the spring 150, the lower end 148 pulls the catch 540 so that the lock plate 530 moves in direction D12 toward the released position P11 (shown in FIG. 20).

Referring again to FIG. 18, the extension member 132 extending outwardly from the slot 130 in the rear wall 108 of the base 100 is coupled to and movable with end member 510 of the carrier assembly 502. As noted above, the lower end 206 of the support post 202 is coupled to the extension member 132 (as shown in FIG. 8).

Referring to FIG. 18, the drive mechanism 500 includes a motor 542 coupled to the carrier assembly 502 via a drive member 544 and a linkage 546. The drive member 544 includes a distal end 544*a* that is rotated about a circular path via actuation of the motor 542. As the distal end 544*a* travels about its circular path, an end 546*a* of the linkage 546 that is pivotally connected to the distal end 544*a* likewise travels about the circular path. An opposite end 546*b* of the linkage 546 is pivotally connected to the carrier assembly 502, such as to side member 506 using a connector such as a screw. The end 546*b* of the linkage 546 thereby pushes and pulls the carrier assembly 502 back and forth in a reciprocating manner along directions D1, D2 as the end 546*a* is moved about its circular path. In this way, the carrier assembly 502 glides back and forth along front rails 520, 522 and rear rails 524, 526 in or along linear directions D1, D2 via actuation of the motor 542.

Actuation of the motor 542 is controlled via a control circuit C, which is in communication with a switch 548, shown in FIGS. 19 and 20. When the lock plate 530 is in the locked position P10, the switch 548 is deactivated, as shown in FIG. 19. The lock plate 530 includes a cam surface 550 aligned with and engageable with the switch 548. As the lock plate 530 moves to the released position P11, shown in FIG. 20, the cam surface 550 engages and depresses the switch 548 inwardly. The switch 548 then sends a signal to the control circuit C indicating activation of the switch 548. The control circuit C, in turn, then activates the motor 542, thereby causing the carrier assembly 502 to move back and forth in linear directions D1, D2 as described above. Thus, when the lock plate 530 is disengaged from the stops 532, 534 in the released position P11, movement of the carrier assembly 502 is permitted in directions D1, D2 via the motor 542.

With continued reference to FIGS. 18-20, actuation of the motor 604 of the drive mechanism 600 is activated via another switch 608 disposed within the cavity 114 of the base 100. In one embodiment, a contact 610 is provided, which is coupled to and movable with the support plate 528. The contact 610 is aligned with the switch 608 when the indents 536, 538 of the lock plate 530 (which is carried by the support plate 528) are aligned with the projection portions 532*a*, 534*a*. When the contact 610 is aligned with the switch 608, the switch 608 is then activated and sends a signal to the control circuit C indicating the alignment. Further, the switch 548 associated with drive mechanism 500 is deactivated when the lock plate 530 moves to its locked position P10.

The control circuit C controls activation of the motor 542 upon activation of switch 548 and activation of the motor 604 upon activation of switch 608. If switch 548 is activated, the control circuit C initiates actuation of the motor 542 of drive mechanism 500 so that the carrier assembly 502 moves in directions D1, D2, while deactivating, or otherwise not activating, operation of the motor 604 of drive mechanism 600. The control circuit C ensures that the motor 604 is maintained in an inoperable state when the motor 542 of drive mechanism 500 is operating, even if the contact 610 is aligned with the switch 608 (for example, when the lock plate 530 is aligned with the stops 532, 534, but remains in the released position P11 as shown in FIG. 20). Once the lock plate 530 moves into its locked position P10, the switch 548 is deactivated as described above, and the control circuit C permits activation of the motor 604. In this way, the drive mechanism 600 is inoperable when the drive mechanism 500 is operating, and the drive mechanism 500 is in a deactivated state when the drive mechanism 600 is operating.

Figure 22:
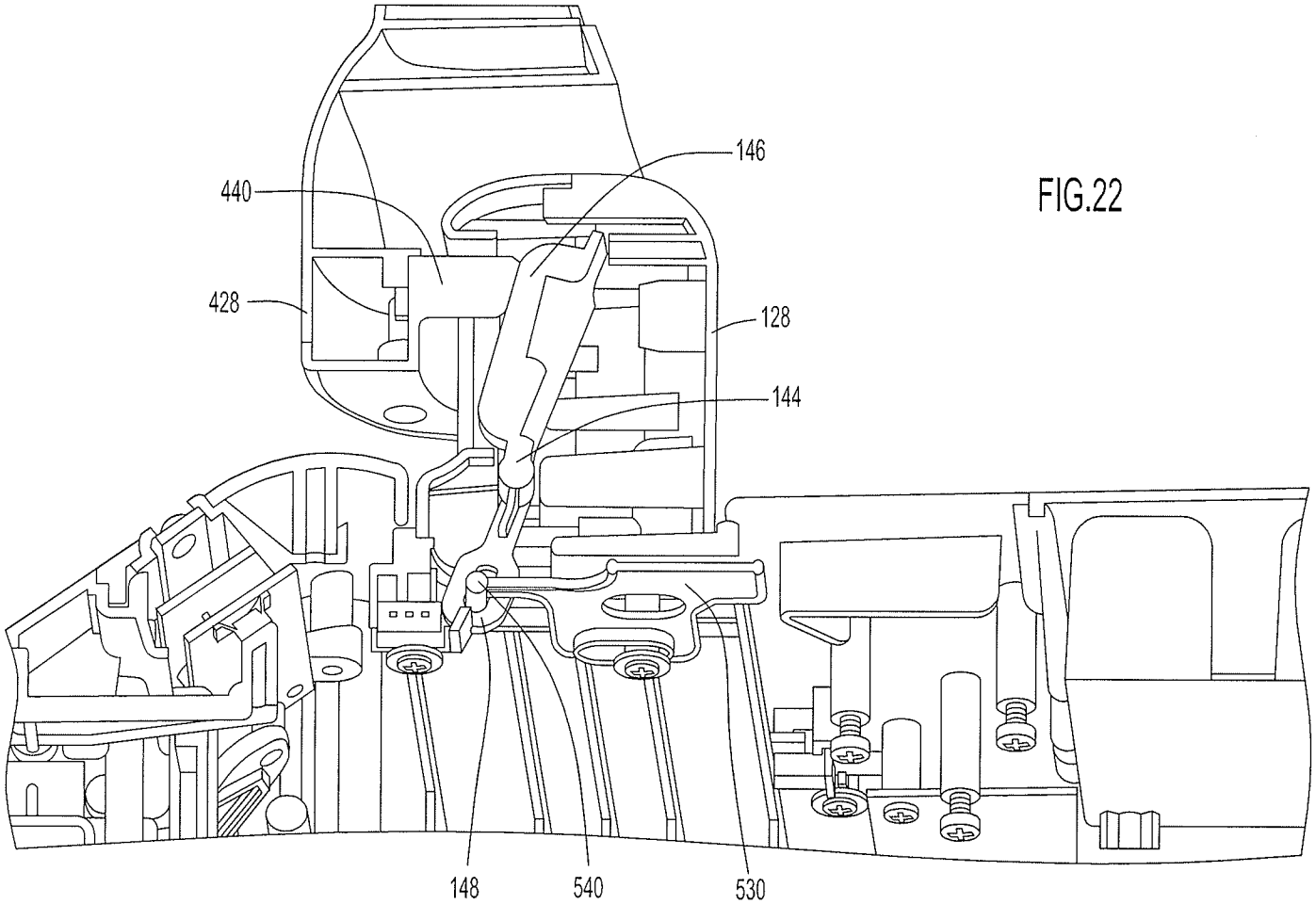
FIG. 22 illustrates a sectional perspective side view of the base showing the coupling mechanism of the mode lever coupled to the coupling mechanism of the base.

Referring to FIGS. 17 and 22, the coupling mechanism 428 of the mode lever 426 includes a protrusion 440 extending from the inner surface 434 and into the receptacle 430. The protrusion 440 is configured to engage the upper end 146 of the latch arm 144 when the mode lever 426 is in its deployed position P9 (shown in FIG. 16). As shown in FIG. 15, the upper end 146 is accessible through an opening in coupling mechanism 128.

Referring to FIG. 22, the upper end 146 of the latch arm 144 is pushed inwardly by the protrusion 440. The coupling mechanism 428 is releasably engaged with the coupling mechanism 128 via the lock tabs 432*a*, 432*b* so that the mode lever 426 is maintained in its deployed position P9. In this way, the lower end 148 of the latch arm 144 pulls the catch 540 so that the lock plate 530 is moved to its released position P11. When in the released position P11, the switch 548 is activated, permitting actuation of the motor 542 via the control circuit C, as described above. The coupling mechanism 128 and the extension member 132 are thereby movable in directions D1, D2 as the carrier assembly 502 moves back and forth in directions D1, D1, as shown in FIG. 18.

The seat portion 400 is releasably coupled to the coupling mechanism 128 via the coupling mechanism 428 when the mode lever 426 is in the deployed position P9. As such, swinging motion of the seat portion 400 is stopped. Instead, the seat portion 400 is moved back and forth in a gliding motion in directions D1, D2 as the carrier assembly 502 moves back and forth, given that the seat portion 400 is coupled to the coupling mechanism 128 and the extension member 132 (via the support 200 and the arm 300), as shown in FIGS. 4 and 8.

Thus, when the mode lever 426 is in its deployed position P9, the support 200, the arm 300 and the seat portion 400 move together in a substantially horizontal, and reciprocating or gliding motion, back and forth in linear directions D1, D2 relative to the base 100 via the drive mechanism 500. The mechanical connection between coupling mechanisms 128, 428 restricts the swinging motion of the arm 300 and the seat portion 400 in directions D3, D4. Further, the drive mechanism 600 is inoperable when the coupling mechanism 128 is coupled to the coupling mechanism 428 due to the resulting position of the lock plate 530, and thus activation of the switch 548 (and control by the control circuit C as described above).

When the coupling mechanism 428 is disengaged from the coupling mechanism 128, such as by depressing the release buttons 436, the mode lever 426 is moved upwardly to its released position P8, as shown in FIG. 15. The upper end 146 of the latch arm 144 of the coupling mechanism 128 is pivoted outwardly toward the opening 142, while the lower end 148 pushes against the catch 540, as shown in FIG. 21. As a result, the lock plate 530 is biased toward its locked position P10 (see FIG. 19).

Figure 23:
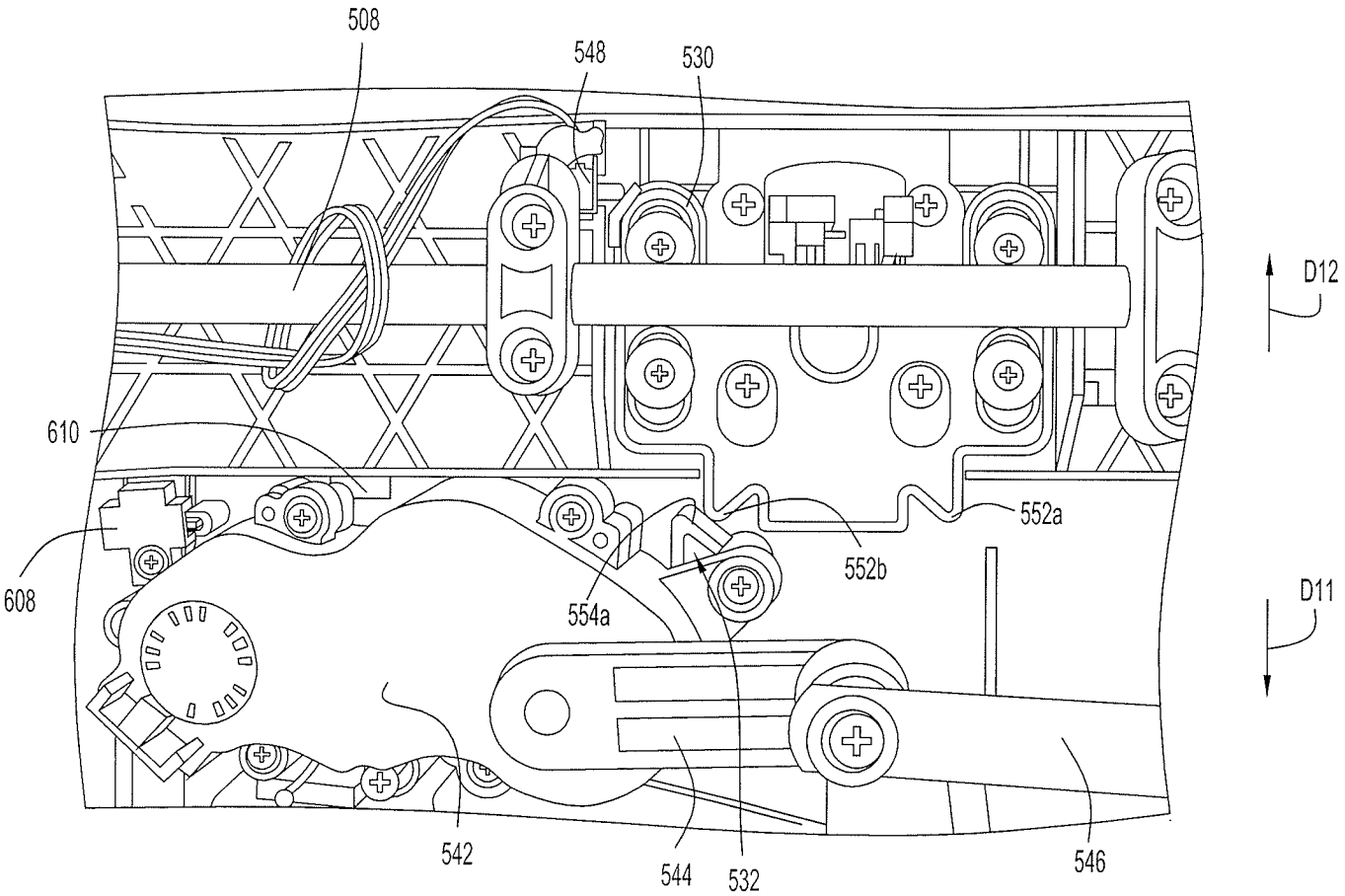
FIG. 23 illustrates a top perspective view of portions of the drive mechanism within the cavity of the base showing the lock plate offset from stops in the cavity.

If the mode lever 426 is moved to its released position P8 when the lock plate 530 is not aligned with stops 532, 534, for example such as shown in FIG. 23, the lock plate 530 is still biased in direction D11. As such, the switch 548 is deactivated. However, the switch 608 is also in a deactivated state given the contact 610 is not aligned with the switch 608. If neither switch 548, 608 is activated, but user controls (described below) are directing that motion of the swing S3 be initiated, the control circuit C activates the motor 542, so that the carrier assembly 502 continues to move until the lock plate 530 is aligned with the stops 532, 534.

Referring to FIGS. 20 and 23, the lock plate 530 includes a rounded projection 552*a*, which engages a cam surface 554*a* of stop 532, so that the lock plate 530 is forced outwardly in direction D12 as it moves in direction D1 until the lock plate 530 is properly aligned with the stops 532, 534. Similarly, the lock plate 530 includes another rounded projection 552*b*, which engages a cam surface 554*b* (shown in FIG. 20) of stop 534, so that the lock plate 530 is forced outwardly in direction D12 as it moves in direction D2 until the lock plate 530 is properly aligned with the stops 532, 534. Once the lock plate 530 is properly aligned with the stops 532, 534, the lock plate 530 slides into its locked position P10 engaging stops 532, 534, as shown in FIG. 19. The motor 542 of the drive mechanism 500 is then deactivated, and the motor 604 activated via the control circuit C.

When the drive mechanism 500 is in an inoperable or deactivated state, the motor 604 of drive mechanism 600 may be activated, so that the arm 300 is moved in a swinging motion via rotation of the drum 606 in directions D5, D6, as described above. As a result, the seat portion 400 is moved in a swinging motion in directions D3, D4, as shown in FIG. 4. Thus, the arm 300 and seat portion 400 are movable by the drive system 500, 600 relative to the base 100 in a first type of motion (e.g. a gliding motion) and in a second type of motion (e.g. a swinging motion) different than the first type of motion.

Figure 24:
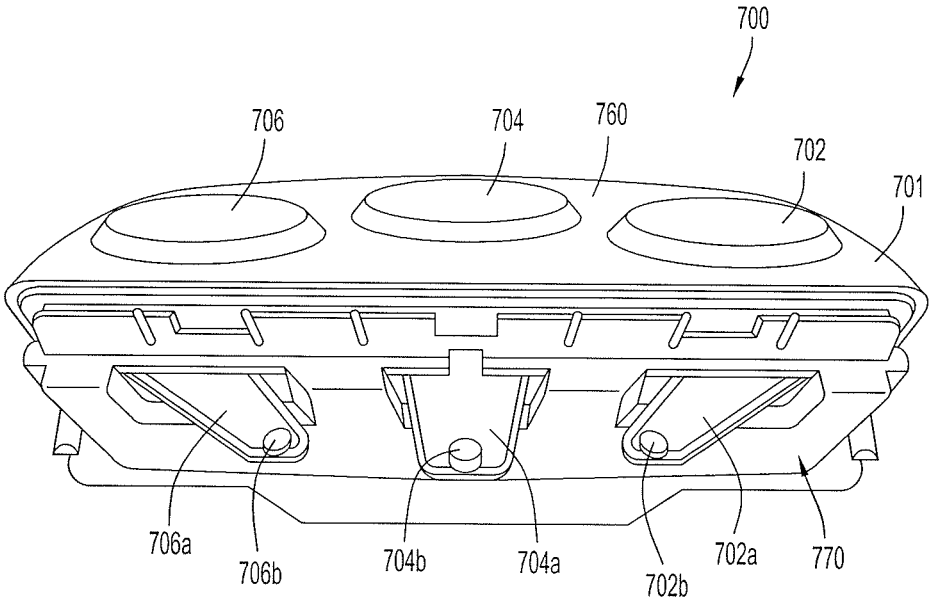
FIG. 24 illustrates a front perspective view of an actuator of the infant swing of FIG. 4.

Referring to FIGS. 4, 5 and 24, actuation of the drive system 500, 600 may be controlled by the user via a foot control assembly, or actuator 700. Actuator 700 is coupled to the base 100 and located proximate to the support surface S, and includes a plurality of inputs 702, 704, 706 that are likewise located proximate to the support surface S, so that the user may easily and comfortably access and actuate the inputs 702, 704, 706 with the user's foot.

In one embodiment, input 702 is an on/off button, which is operably coupled to a switch 708 (shown in FIG. 18) for sending a signal to the control circuit C to activate or deactivate a power source for the drive system 500, 600. The motors 542, 604 of drive system 500, 600 are coupled to and powered by the power source, such as batteries disposed within a compartment 152 provided within the cavity 114 of the base 100. In addition or alternatively, the drive system 500, 600 may be powered by an associated AC adapter and power cord connected to a power source (e.g. an electrical outlet). An initial depression of input 702 activates the power source, and the subsequent depression of input 702 deactivates the power source.

Input 704 is operably coupled to another switch 710, which sends a signal to the control circuit C to activate or deactivate an audio output via an operably associated speaker 712 (see FIG. 18) configured for sound emission and/or to control the volume of the audio output. For example, music, sound effects, or one or more songs may be stored in a memory in communication with the control circuit C, which are output in series or randomly upon depression of input 704. The volume level may be increased or decreased upon a predetermined number of subsequent depressions, and/or the music output may be stopped following a specific number of subsequent depressions.

Input 706 is operably coupled to another switch 714, which sends a signal to the control circuit C to activate or deactivate the drive system, and in particular, one of the drive mechanisms 500, 600. For example, after the power source has been activated via input 702, a depression of input 706 may activate the drive system 500, 600 to initiate a selected motion of the seat portion 400. The speed of the motion may be selectively controlled via subsequent depression of input 706. For example, a relatively slow speed of motion may be initiated upon the initial depression of input 706, and progressively increased with each subsequent depression of input 706 until a maximum speed of motion is reached (e.g. after five consecutive depressions of input 706). After the maximum speed of motion has been reached, the next subsequent depression of input 706 may deactivate the drive system 500, 600.

Referring again to FIG. 24, the actuator 700 has a housing 701 with an upper surface 760 with several openings formed therein. The housing 701 also includes a rear surface 770 with several openings formed therein. The housing 701 can be removably coupled to the base 100 by sliding the housing 701 into the opening 705 defined by edge 703 along the front wall of the base 100. The housing 701 includes a ridge or groove 765 with which the edge 703 engages. Thus, the housing 701 can be snapped or otherwise frictionally engaged with the base 100.

As shown in FIG. 24, the inputs 702, 704, and 706 extended above the upper surface 760 through openings in the upper surface 760. Input 702 is coupled to a lever 702*a* which is pivotally mounted and extends through an opening on the rear surface 770 of the housing 701. Lever 702*a* can be pivoted upwardly and a contact portion 702*b* engages against switch 708 upon the depression of input 702, thereby activating switch 708. Similarly, input 704 is coupled to a lever 704*a* which is pivotally mounted and extends through an opening on the rear surface 770 of the housing 701. Lever 704*a* can be pivoted upwardly and a contact portion 704*b* engages against switch 710 upon depression of input 704, thereby activating switch 710. Also, input 706 is coupled to a lever 706*a* which is pivotally mounted and extends through an opening on the rear surface 770 of the housing 701. Lever 706*a* can be pivoted upwardly and a contact portion 706*b* engages against switch 714 upon depression of input 706, thereby activating switch 714. Thus, each of the inputs 702, 704, and 706 mechanically engages a corresponding one of the switches 708, 710, and 712 when the particular input is engaged by a toe or foot of a user or an article of footwear being worn by the user. In different embodiments, the sizes, shapes, and quantity of inputs 702, 704, and 706 on actuator 700 can vary.

Thus, the actuator 700 allows a user to easily turn the swing S3 on or off, start or stop the gliding or swinging motion, control the speed of the swinging or gliding motion, and control the audio output using a foot of the user. Thus, the inputs 702, 704, 706 are configured to be easily depressed by a user's toe or foot, or article of footwear being worn on the foot of the user. In this way, the swing S3 may be controlled "hands free," which is advantageous if the user is carrying an object or otherwise not readily able to use his or her hands to adjust movement or audio output of or otherwise control the swing S3.

A power indicator light 716, such as an LED, may be provided on the base 100, as shown in FIGS. 4 and 5. Similarly, another indicator light 718 may be provided on the base 100 which indicates the volume level of the audio output, or alternatively the speed of the movement of the seat portion 400. In one embodiment, a slide switch 720 is provided on the base 100 and in communication with the control circuit C for controlling volume level of the audio output.

It should be understood that the switch and input arrangement described above is exemplary, and various other configurations may be employed. For example, individual input buttons may be provided for controlling sound level, speed, song selection, etc. In addition, other control circuit arrangements may be employed. In one embodiment, the actuator is removably coupled to the base 100. In another embodiment, the actuator is removably coupled to the base 100, and includes a control circuit wirelessly coupled to the switches within the base 100 so that control of the infant swing S3 may be performed from a remote location.

Figure 25:
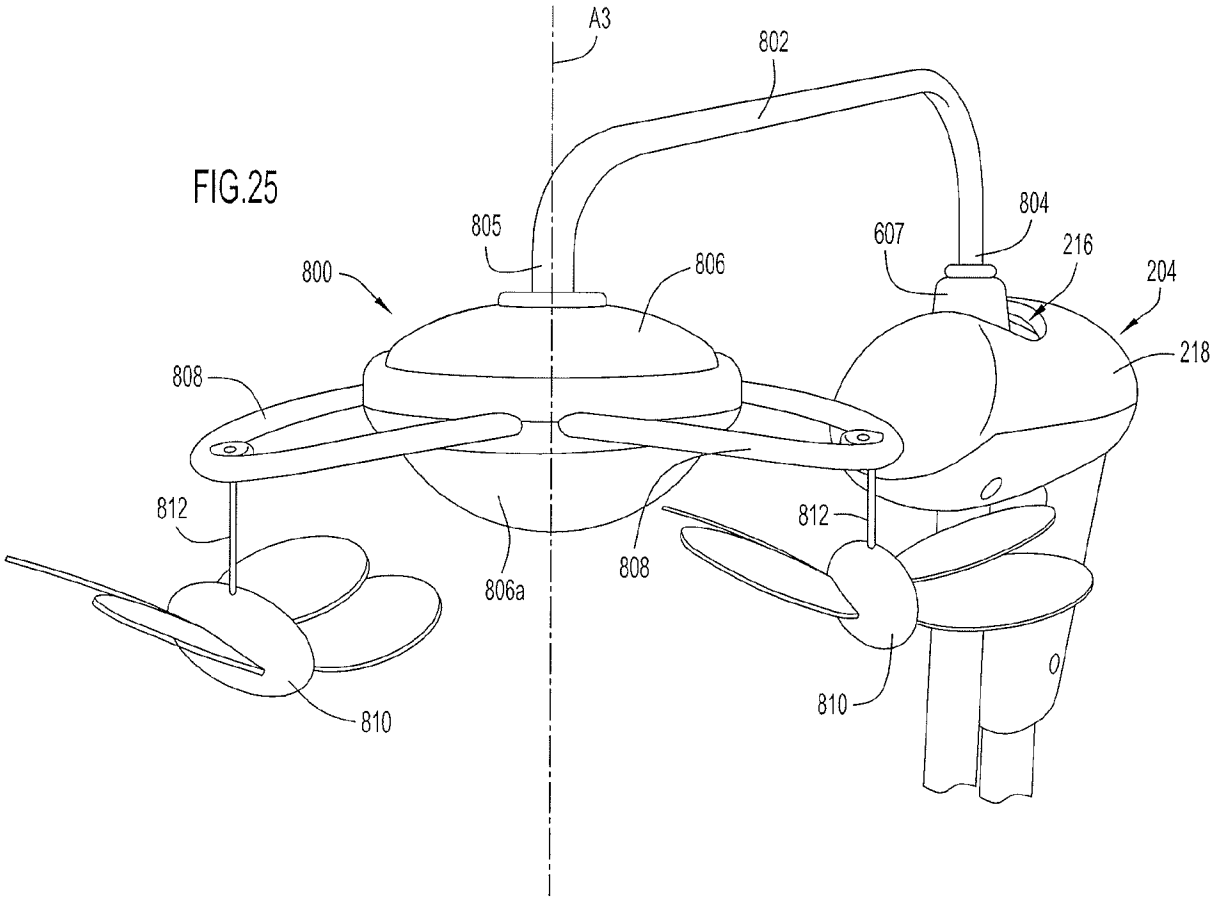
FIG. 25 illustrates a perspective view of a mobile assembly of the infant swing of FIG. 4.

Referring to FIG. 25, in one embodiment the infant swing S3 includes a mobile assembly 800 coupled to the upper housing assembly 204 of the support 200. The mobile assembly 800 includes a strut or bar 802 having an end portion 804 coupled to and inserted into an opening 609 in the boss 607 of the upper housing assembly 204, and an opposite end portion 805 coupled to a hub 806. In one embodiment, the end portion 804 is coupled to the drum 606 (shown in FIG. 10). In this way, rotational movement of the drum 606 in directions D5, D6 causes the arm 300 to move in a swinging motion, while simultaneously causing the strut 802 to move in a swinging motion. The arm 300 extends downwardly from the axis A1 about which the drum 606 rotates, while the strut 802 extends upwardly from the rotational axis A1. As a result, the arcuate path along which the strut 802 travels is inverse to the arcuate path along which the arm 300 moves. In addition, as the arm 300 moves in direction D3, the strut moves in an opposite direction D13, as shown in FIG. 5. Similarly, as the arm 300 moves in direction D4, the strut moves in an opposite direction D14.

Accordingly, the hub 806 moves along an arcuate path that is inverse to the arcuate path along which the arm 300 moves, and moves in a direction that is opposite to the direction in which the arm 300 moves. The hub 806 includes one or more outwardly extending braces or wings 808. Toy elements 810 are attached to each of the wings 808, such as by flexible cords or string 812, so that pivotal movement of the hub 806 imparts additional movement upon the toy elements 810. In one embodiment, the hub 806 is movably coupled to the end portion 805. For example, the hub 806 may be rotatable about an axis A3, and easily spinable by an infant sitting in the seat 404 when the infant bats at the toy elements 810.

Alternatively or in addition, the hub 806 may include other features for entertaining the infant, such as a mirrored underside 806*a* visible to the infant sitting in the seat 404, additional or different toy elements coupled thereto, other visual features such as lights, etc.

Figure 26:
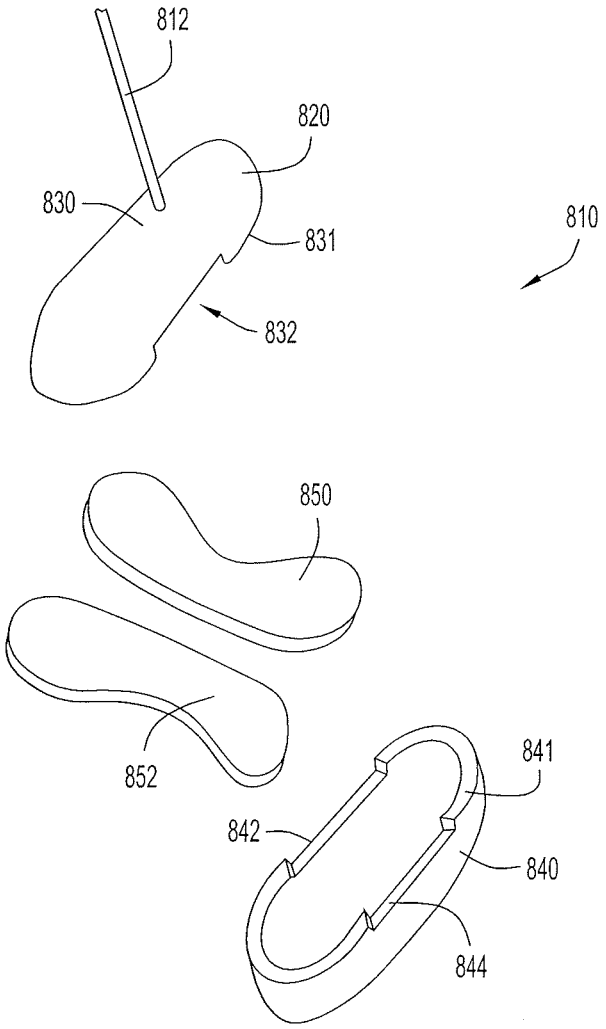
FIG. 26 illustrates an exploded perspective view of a hanging object of the mobile assembly of FIG. 25.

Referring to FIG. 26, an exploded perspective view of an element 810 is illustrated. In this embodiment, the element 810 includes a housing 820 and a pair of wings 850 and 852. The housing 820 is molded plastic and includes housing portions 830 and 840. Housing portion 830 has the hanging structure, such as a string, 812 coupled thereto. Housing portion 830 also includes a pair of slots 832 formed along edge or surface 831 (only slot 832 is illustrated). Housing portion 840 includes a pair of slots 842 and 844 formed along edge or surface 841 as shown. The housing portions 830 and 840 may be coupled together using a technique such as an adhesive or some other mechanical coupling structure. The housing portions 830 and 840 are coupled together so that the edges 831 and 841 are in contact with each other.

The wings 850 and 852 are molded plastic pieces which may be translucent or transparent to allow light to shine therethrough. The wings 850 and 852 can have different colors. The wings 850 and 852 are captured between the housing portions 830 and 840 and located in the slots 832, 842, and 844. Each of the wings 850 and 852 has slightly tapered end portions.

Figure 27:
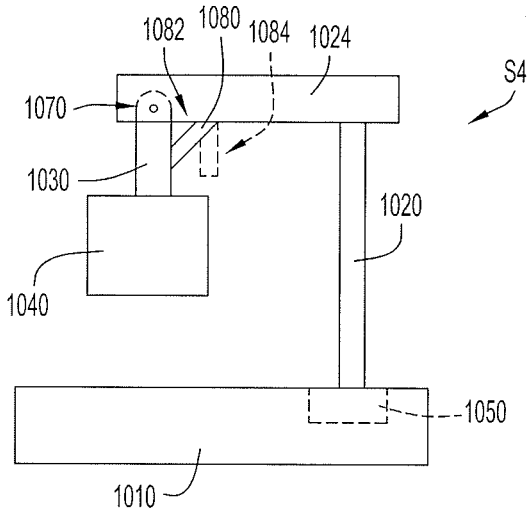
FIG. 27 illustrates an alternative embodiment of an infant swing according to the invention.
Figure 28:
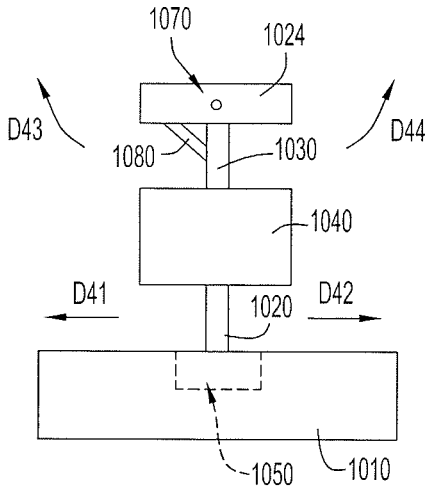
FIG. 28 illustrates the infant swing of FIG. 27 in a first configuration.
Figure 29:
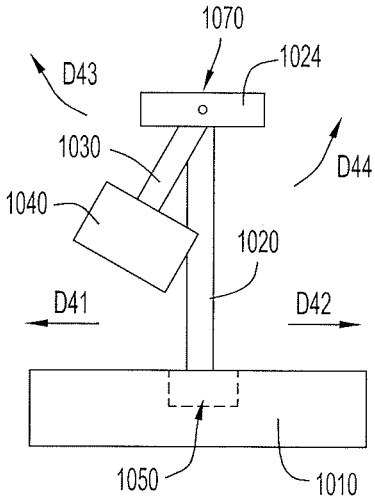
FIG. 29 illustrates the infant swing of FIG. 27 in a second configuration.

Referring to FIGS. 27-29, an alternative embodiment of an infant swing is illustrated. In this embodiment, the infant swing S4 has a base 1010 that is configured to be placed on and supported by a support surface. The swing S4 also includes a support 1020 that is movably coupled to the base 1010. The support 1020 is moved relative to the base 1010 along the directions of arrows D41 and D42 in FIG. 28 by a drive mechanism 1050. When operated, the drive mechanism 1050 moves the support 1020 in a reciprocating manner relative to the base 1010.

The support 1020 has an upper portion 1024 to which a hanger arm 1030 is pivotally coupled at pivot point 1070. The hanger arm 1030 is mounted for arcuate movement along the directions of arrows D43 and D44 (see FIGS. 28 and 29) about pivot point 1070. Coupled to the hanger arm 1030 is a seat or seat portion 1040 that is configured to receive an infant.

The swing S4 also includes a locking mechanism 1080 that is coupled to the upper portion 1024 and engageable with the hanger arm 1030. The locking mechanism 1080 is pivotally coupled to the upper portion 1024 and movable between a deployed or locked position 1082 and a released or unlocked position 1084.

When the locking mechanism 1080 is in its deployed position 1082, the hanger arm 1030 and the seat 1040 do not move relative to the support 1020. Thus, when the support 1020 is moved by drive mechanism 1050 in a gliding motion along the directions D41 and D42, the hanger arm 1030 and the seat 1040 move therewith along the directions D41 and D42 in a similar, gliding manner.

When the locking mechanism 1080 is in its released position 1084, the hanger arm 1030 and the seat 1040 can move relative to the support 1020 about pivot point 1070. In particular, when the support 1030 is moved by drive mechanism 1050 in a gliding motion along the directions D41 and D42, the hanger arm 1030 and the seat 1040 initially move in the same manner. However, as the pivot point 1070 translates or reciprocates back and forth, the hanger arm 1030 and the seat 1040 begin to swing relative to the upper portion 1024 and the pivot point 1070. In other words, as support 1020 and pivot point 1070 move along the direction D41, the hanger arm 1030 and seat 1040 move therewith. As support 1020 and pivot point 1070 move in the opposite direction D42, the hanger arm 1030 and seat 1040 lag slightly behind the movement of the support 1020. This process continues to repeat itself as the support 1020 changes its direction of travel. Referring to FIG. 29, the hanger arm 1030 and the seat 1040 are illustrated in a swinging position relative to the support 1020 and pivot point 1070. Thus, the linear, reciprocating motion of the support 1020 is translated to arcuate or swinging motion of the hanger arm 1030 and the seat 1040. When the drive mechanism 1050 is turned off, the movement of the support 1020 relative to the base 1010 stops and the seat 1040 continues to swing until its energy dissipates.

Although the disclosed inventions are illustrated and described herein as embodied in one or more specific examples, it is nevertheless not intended to be limited to the details shown, since various modifications and structural changes may be made therein without departing from the scope of the inventions and within the scope and range of equivalents of the claims. In addition, various features from one of the embodiments may be incorporated into another of the embodiments. Accordingly, it is appropriate that the appended claims be construed broadly and in a manner consistent with the scope of the disclosure as set forth in the following claims.

What is claimed is:

1. An infant swing, comprising:

a base configured to be supported by a support surface;

a support coupled to the base;

an arm coupled to and movable relative to the support;

a seat portion coupled to the arm, the seat portion being configured to support an infant;

a drive system coupled to the arm, the drive system moving the arm relative to the base; and an actuator connected to the drive system, the actuator being located proximate to the support surface so that a user, other than an infant supported in the seat portion, can engage the actuator with a foot of the user to control the drive system.

2. The infant swing of claim 1, wherein the arm is movable by the drive system relative to the base in a first type of motion and in a second type of motion different than the first type of motion.

3. The infant swing of claim 2, wherein the first type of motion is a gliding motion relative to the base and the second type of motion is a swinging motion relative to the base.

4. The infant swing of claim 2, wherein the drive system includes a first drive mechanism that moves the arm in the first type of motion and a second drive mechanism that moves the arm in the second type of motion.

5. The infant swing of claim 1, wherein the actuator includes a plurality of inputs that are located proximate to the support surface.

6. The infant swing of claim 1, wherein the actuator is removably coupled to the base.

7. The infant swing of claim 1, wherein the support extends upwardly from the base and is movably coupled to the base.

8. The infant swing of claim 7, wherein the support moves in a substantially horizontal reciprocating motion relative to the base.

9. The infant swing of claim 7, wherein the actuator is removably coupled to the base, the actuator being located proximate to the support surface.

10. The infant swing of claim 1, wherein the drive system moves the arm in a swinging motion.

11. An infant swing, comprising:

a base portion;

a support coupled to the base portion;

a seat portion coupled to the support, the seat portion being movable relative to the base portion in a gliding motion and in a swinging motion; and a drive assembly configured to move the seat portion relative to the base portion, the drive assembly including a first drive mechanism that moves the seat portion in the gliding motion and a second drive mechanism that moves the seat portion in the swinging motion.

12. The infant swing of claim 11, wherein the first drive mechanism is coupled to the base portion and the second drive mechanism is coupled to the seat portion.

13. The infant swing of claim 11, further comprising:

an input portion connected to the drive assembly, the input portion including at least one input configured to control at least one of the first drive mechanism or the second drive mechanism, the input portion being removably coupled to the base portion.

14. The infant swing of claim 13, wherein the base portion is configured to engage a support surface and the input portion is disposed proximate to the support surface.

15. The infant swing of claim 13, wherein the input portion is located so that a user can select the at least one input with a foot of the user.

16. The infant swing of claim 11, wherein the first drive mechanism moves the seat portion in a substantially linear motion relative to the base portion.

17. An infant swing, comprising:

a base;

a support movably coupled to the base;

a hanger arm movably coupled to the support;

a seat coupled to the hanger arm; and a drive assembly, the drive assembly being configured to move the support and the hanger arm relative to the base in a first type of motion, and the drive assembly being configured to move the hanger arm relative to the support and the base in a second type of motion, the second type of motion being different than the first type of motion.

18. The infant swing of claim 17, wherein the drive assembly includes a first drive mechanism and a second drive mechanism.

19. The infant swing of claim 18, wherein the first drive mechanism is coupled to the support and the base, and the second drive mechanism is coupled to the hanger arm and the support.

20. The infant swing of claim of 19, wherein the seat, the hanger arm, and the support move together in the first type of motion when the first coupling mechanism and the second coupling mechanism are coupled together.

21. The infant swing of claim 18, wherein the seat includes a first coupling mechanism and the support includes a second coupling mechanism, the first coupling mechanism is configured to engage the second coupling mechanism to couple the seat to the support, and the second drive mechanism is inoperable when the first coupling mechanism is coupled to the second coupling mechanism.

22. The infant swing of claim 18, wherein the first drive mechanism moves the seat, the hanger arm, and the support in the first type of motion.

23. The infant swing of claim 18, wherein the second drive mechanism moves the seat and the hanger arm relative to the support in the second type of motion.

24. The infant swing of claim 17, wherein the first type of motion is substantially linear and the second type of motion is substantially accurate.

25. The infant swing of claim 17, wherein the support moves linearly relative to the base in the first type of motion, and the support is substantially fixed relative to the base in the second type of motion.

26. The infant swing of claim 17, wherein the hanger arm is pivotally coupled to the support.

27. The infant swing of claim 17, wherein the support has an upper portion and a lower portion, the lower portion of the support is coupled to the base, and the hanger arm is coupled to the upper portion of the support.

28. The infant seat of claim 17, wherein the seat includes a first coupling mechanism and the support includes a second coupling mechanism, the first coupling mechanism being configured to engage the second coupling mechanism to couple the seat to the support.

29. An infant swing, comprising:

a base;

a movement system coupled to the base, the movement system including a first drive and a second drive; and a receiving member coupled to the movement system, the receiving member being configured to receive an infant, the first drive moving the receiving member in a gliding motion relative to the base, and the second drive moving the receiving member in a swinging motion relative to the base.

30. The infant swing of claim 29, wherein only one of the first drive or the second drive is operable at one time.

31. The infant swing of claim 29, wherein the movement system has a lock-out mechanism, and when deployed, the lock-out mechanism limits the movement of the receiving member to the gliding motion.

32. The infant swing of claim 31, wherein the receiving member can move in the swinging motion when the lock-out mechanism is released.

33. The infant swing of claim 29, wherein the movement system includes a foot-actuatable input mechanism, the input mechanism being connected to at least one of the first drive or the second drive.

34. The infant swing of claim 33, wherein the input mechanism is removably coupled to the base.

35. The infant swing of claim 29, wherein the base includes a slot, and the movement system includes a support arm extending upwardly from the base, the support arm being movable in the slot.

36. The infant swing of claim 35, wherein the support arm includes an upper portion, and the receiving member is supported by the upper portion of the support arm.

* * * * *